US009563149B2

(12) United States Patent
Akaike et al.

(10) Patent No.: US 9,563,149 B2
(45) Date of Patent: Feb. 7, 2017

(54) DEVELOPER COLLECTION CONTAINER AND IMAGE FORMING APPARATUS

(71) Applicant: FUJI XEROX CO., LTD., Tokyo (JP)

(72) Inventors: Takashi Akaike, Kanagawa (JP); Shota Matsumae, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/831,226

(22) Filed: Aug. 20, 2015

(65) Prior Publication Data

US 2016/0209776 A1 Jul. 21, 2016

(30) Foreign Application Priority Data

Jan. 15, 2015 (JP) ..... 2015-005552

(51) Int. Cl.
*G03G 21/00* (2006.01)
*G03G 15/08* (2006.01)
*G03G 21/12* (2006.01)

(52) U.S. Cl.
CPC ..... *G03G 15/0881* (2013.01); *G03G 21/12* (2013.01)

(58) Field of Classification Search
CPC ..... G03G 15/0881
USPC ..... 399/106, 358, 360
See application file for complete search history.

(56) References Cited

U.S. PATENT DOCUMENTS 5,708,952 A * 1/1998 Taniguchi ..... G03G 15/0822 399/120
2008/0124119 A1* 5/2008 Oda ..... G03G 15/0898 399/120

FOREIGN PATENT DOCUMENTS

JP 2010-032657 A 2/2010
JP 2012-103483 A 5/2012

* cited by examiner

*Primary Examiner* — Quana M Grainger
(74) *Attorney, Agent, or Firm* — Oliff PLC

(57) ABSTRACT

A developer collection container includes a connecting part removably connected to a discharge structure by moving relative to the discharge structure, the connecting part having a receiving opening to receive developer discharged from a discharge opening of the discharge structure, a storage part for storing the discharged developer, an opening and closing member provided in an area of the connecting part where the receiving opening is provided, the opening and closing member moving parallel to the area in conjunction with relative movement of the connecting part for displacement between close and open positions to close and open the receiving opening and having a covering part, and a sealing member provided around the receiving opening in the area, the sealing member sealing a gap formed between the covering part and the area and sealing at least a gap formed between the surrounding part of the discharge opening and the area.

18 Claims, 16 Drawing Sheets

DEVELOPER COLLECTION CONTAINER AND IMAGE FORMING APPARATUS

CROSS-REFERENCE TO RELATED APPLICATIONS

This application is based on and claims priority under 35 USC 119 from Japanese Patent Application No. 2015-005552 filed Jan. 15, 2015.

BACKGROUND

Technical Field

The present invention relates to a developer collection container and an image forming apparatus.

SUMMARY

According to an aspect of the invention, there is provided a developer collection container including a connecting part that is removably connected to a discharge structure by moving relative to the discharge structure, the discharge structure having a discharge opening through which a developer to be collected is discharged, the connecting part having a receiving opening that comes to face the discharge opening of the discharge structure to receive the developer discharged and dropped from the discharge opening, a storage part that is provided below the connecting part in a direction of gravity to store the developer received from the receiving opening, an opening and closing member that is provided in an area of the connecting part where the receiving opening is provided, the opening and closing member being displaced between a close position and an open position by moving substantially in parallel to the area in conjunction with relative movement of the connecting part with respect to the discharge structure, the open position being a position that opens the receiving opening, the close position being a position that closes the receiving opening, the opening and closing member having a covering part that covers the receiving opening when the opening and closing member is in the close position, and a sealing member that is provided around the receiving opening in the area of the connecting part where the receiving opening is provided, the sealing member sealing a gap between the covering part and the area when the opening and closing member is in the close position, the sealing member sealing at least a gap between a surrounding part of the discharge opening of the discharge structure and the area when the discharge structure is connected with the connecting part.

BRIEF DESCRIPTION OF THE DRAWINGS

Exemplary embodiments of the present invention will be described in detail based on the following figures, wherein.

DETAILED DESCRIPTION

Hereinafter, exemplary modes for carrying out the present invention (to be simply referred to as "exemplary embodiments" hereinafter) will be described with reference to the attached figures.

Exemplary Embodiment 1

FIGS. 1 to 4 illustrate an image forming apparatus 1 including a developer collection box that is an example of a developer collection container according to Exemplary Embodiment 1.

Figure 1:
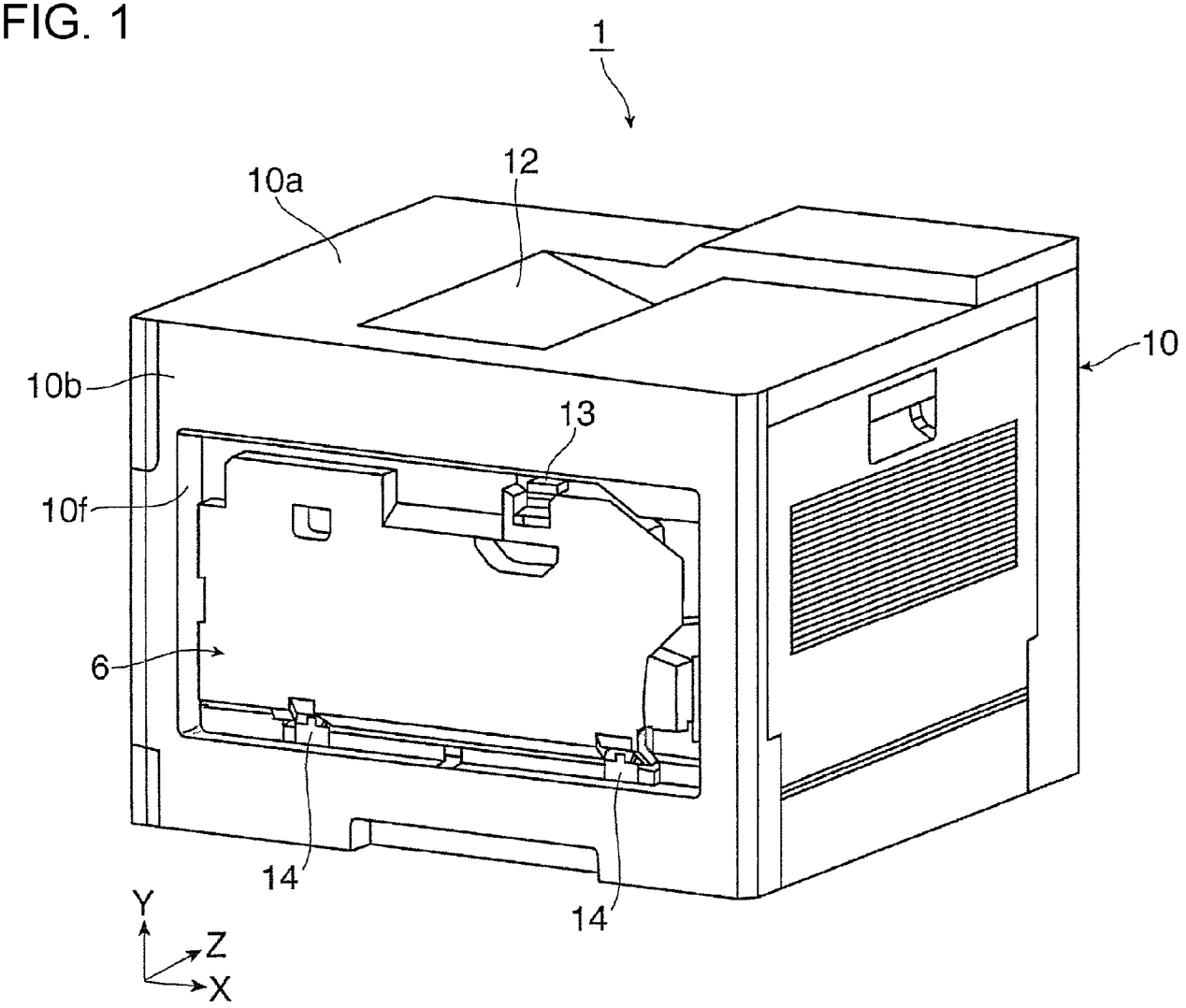
FIG. 1 is a perspective view of the outward appearance (with an exterior cover being open) of an image forming apparatus according to Exemplary Embodiment 1.
Figure 2:
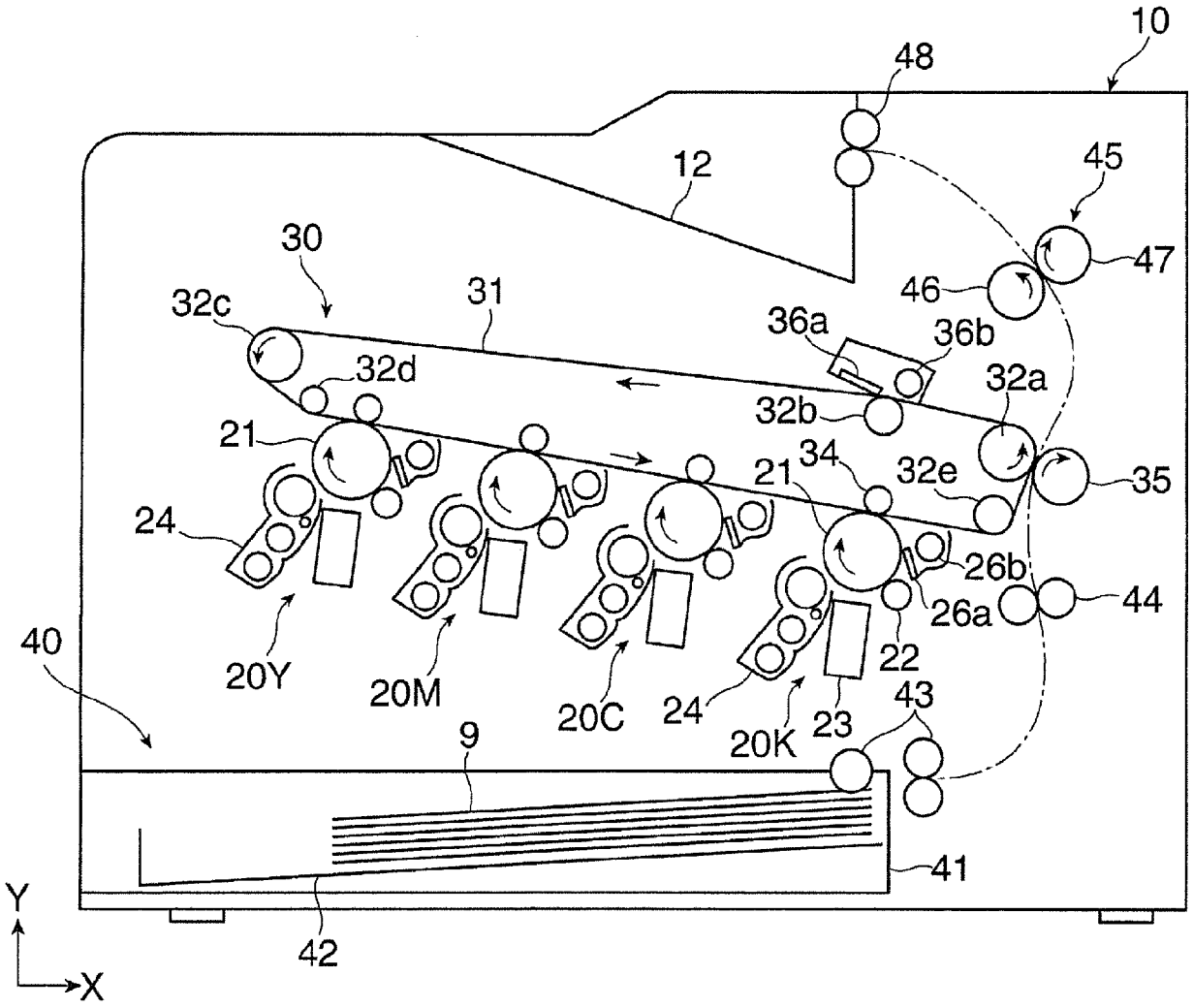
FIG. 2 is a schematic diagram illustrating an internal structure of the image forming apparatus illustrated in FIG. 1.
Figure 3:
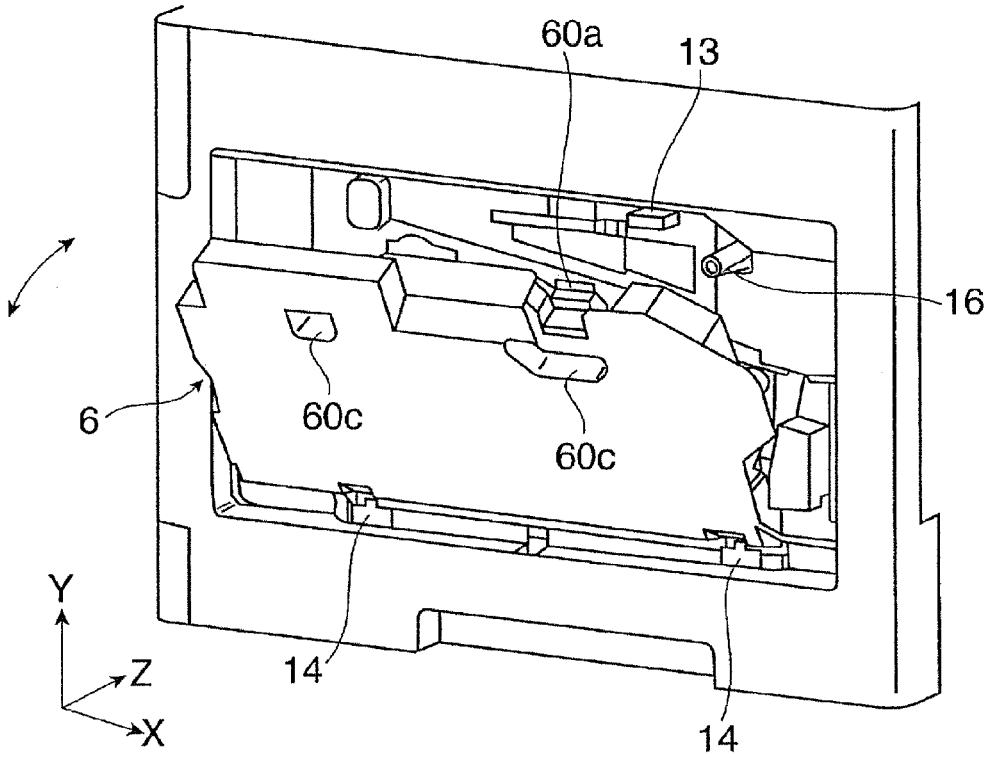
FIG. 3 is a perspective view of a part of the image forming apparatus illustrated in FIG. 1 at a point in time during installation/removal of a developer collection box.
Figure 4:
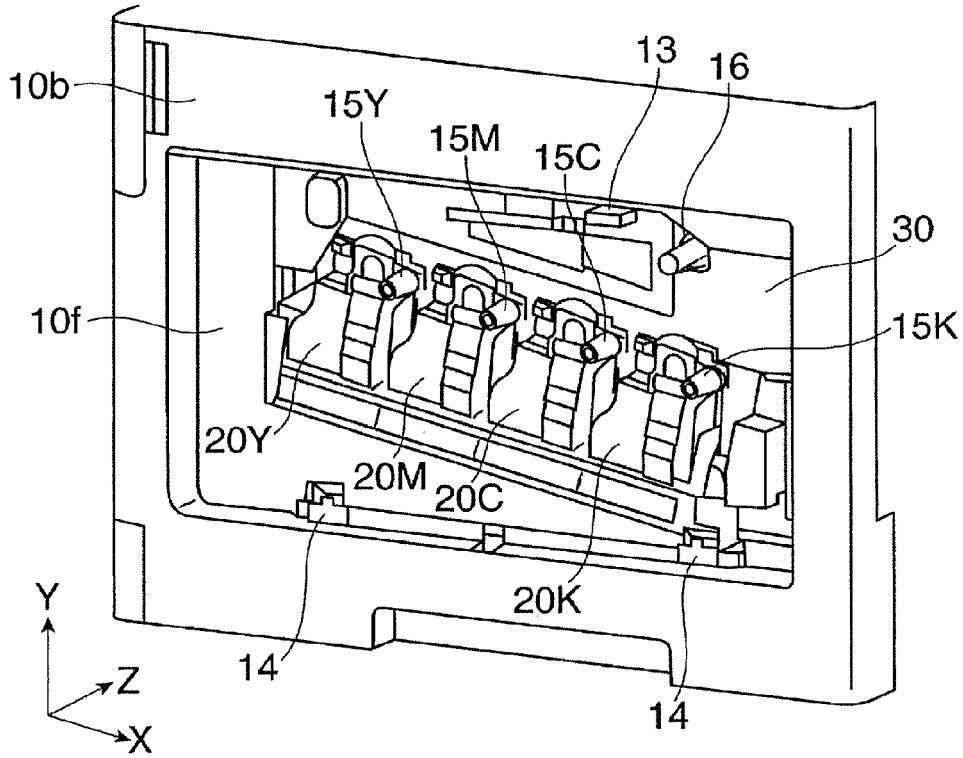
FIG. 4 is a perspective view of a part of the image forming apparatus illustrated in FIG. 1, with a developer collection box being removed.

FIG. 1 is a perspective view of the outward appearance (with an exterior cover being open) of the image forming apparatus 1 according to Exemplary Embodiment 1. FIG. 2 is a schematic diagram illustrating an internal structure of the image forming apparatus 1. FIG. 3 is a perspective view of a part of the image forming apparatus 1 at a point in time during installation/removal of a developer collection box. FIG. 4 is a perspective view of a part of the image forming apparatus 1 with the developer collection box being removed. Arrows indicated by reference signs X, Y, and Z in the figures including FIG. 1 denote (the directions of) orthogonal coordinate axes representing the directions of width, height, and depth, respectively, of a three-dimensional space assumed in the figures.

<General Configuration of Image Forming Apparatus>

The image forming apparatus 1 forms an image made with developer on recording paper 9 that is an example of a recording medium. For example, the image forming apparatus 1 is a printer that forms an image in response to an input of image information from external equipment such as an information terminal.

The image forming apparatus 1 has a housing 10 having a generally box-like outward appearance. As illustrated in FIG. 2, components such as an image forming device 20, an intermediate transfer device 30, a paper feeder 40, and a fixing device 45 are disposed inside the housing 10. The image forming device 20 forms a toner image made with toner that is an example of developer. The intermediate transfer device 30 relays and transports the toner image formed by the image forming device 2, and finally transfers the toner image to the recording paper 9 for second transfer. The paper feeder 40 stores and feeds the recording paper 9 that is to be supplied to a second transfer position of the intermediate transfer device 30. The fixing device 45 fixes the toner image transferred by second transfer by the intermediate transfer device 30, onto the recording paper 9. A top face portion 10*a* of the housing 10 is provided with an output/storage part 12. The recording paper 9 on which an image has been formed is output to the output/storage part 12 to be stored in the output/storage part 12 in a stacked state. An alternate long and short dash line illustrated in FIG. 2 indicates a representative transport path of the recording paper 9 within the housing 10.

The image forming device 20 according to Exemplary Embodiment 1 includes four image forming devices 20Y, 20M, 20C, and 20K that individually form developer (toner) images of four colors, yellow (Y), magenta (M), cyan (C), and black (K), respectively. The image forming devices 20 (Y, M, C, and K) according to Exemplary Embodiment 1 are disposed inside the housing 10 in such a way (in an inclined state) so as to become gradually higher in level in order of black, cyan, magenta, and yellow.

Each of the four image forming devices 20 (Y, M, C, and K) includes components such as a photoconductor drum 21, a charging device 22, an exposure device 23, a developing device 24, and a drum cleaner 26. The photoconductor drum 21 is a photoconductor in the form of a drum which is rotationally driven in the direction indicated by an arrow (clockwise direction in FIG. 2). The charging device 22 charges the peripheral surface of the photoconductor drum 21, which is a region of the photoconductor drum 21 on which to form an image, to a predetermined required potential. The exposure device 23 irradiates the charged peripheral surface of the photoconductor drum 21 with light decomposed into each individual color component based on predetermined required image information, thereby forming an electrostatic latent image of each individual color component. The developing device 24 develops the electrostatic latent image with a toner of each individual color component to render a visible toner image for each of the color components mentioned above. The drum cleaner 26 cleans the photoconductor drum 21 by removing unnecessary substances such as toner that remain on the peripheral surface of the photoconductor drum 21 after the toner image on the photoconductor drum 21 is transferred by first transfer to (an intermediate transfer belt 31 of) the intermediate transfer device 30.

Among these components, toners of color components corresponding to the four colors mentioned above are stored in the developing device 24. Developer (mostly toner) is added to the developing device 24 from a developer adding part (not illustrated) in accordance with, for example, the amount of developer that has been consumed. Further, the drum cleaner 26 has components such as a cleaning member 26*a* and a rotary transport member 26*b* that are disposed inside the housing of the drum cleaner 26. The cleaning member 26*a*, which is an elastic plate or the like, comes into contact with the photoconductor drum 21 to scrape off unnecessary substances such as residual toner. The rotary transport member 26*b*, which is a screw auger or the like, sends out the residual toner scraped off by the cleaning member 26*a* toward a developer collection box 6 as waster toner.

In each of the image forming devices 20 (Y, M, C, and K), upon receiving a request for forming an image, the peripheral surface of the photoconductor drum 21 that starts to rotate is charged to a predetermined required potential by the charging device 22. Then, the charged peripheral surface of the photoconductor drum 21 is irradiated with light corresponding to an image signal of each individual color component from the exposure device 23, thereby forming an electrostatic latent image of each individual color component. Subsequently, the electrostatic latent image of each individual color component formed on the peripheral surface of the corresponding photoconductor drum 21 is developed with a toner of one of the above-mentioned four colors (Y, M, C, and K) in the corresponding developing device 24, thus forming a toner image of each of the four colors on the corresponding photoconductor drum 21.

The intermediate transfer device 30 is disposed vertically above the four image forming devices 20 (Y, M, C, and K), in a slightly inclined state corresponding to the inclined disposition of the image forming devices 20 (Y, M, C, and K). The intermediate transfer device 30 according to Exemplary Embodiment 1 includes components such as the intermediate transfer belt 31, multiple support rollers 32*a* to 32*e*, a first transfer device 34, a second transfer device 35, and a belt cleaner 36. The intermediate transfer belt 31 is an endless belt to which a toner image formed on the photoconductor drum 21 of each of the image forming devices (Y, M, C, and K) can be transferred by an electrostatic action so as to be carried by the intermediate transfer belt 31. The support rollers 32*a* to 32*e* support the intermediate transfer belt 31 in such a way that the intermediate transfer belt 31 rotates so as to sequentially pass through the respective first transfer positions of the image forming devices 20 (Y, M, C, and K). The first transfer device 34, which is in the form of a roller or the like disposed inside the intermediate transfer belt 31, transfers a toner image formed on the photoconductor drum 21 of each of the image forming devices 20 (Y, M, C, and K) to the peripheral surface of the intermediate transfer belt 31 for first transfer. The second transfer device 35, which is in the form of a roller or the like, transfers the toner image transferred by first transfer to the intermediate transfer belt 31, to the recording paper 9 for second transfer. The belt cleaner 36 cleans the intermediate transfer belt 31 by removing unnecessary substances such as toner that remain on the peripheral surface of the intermediate transfer belt 31 after the second transfer.

Among these components, the support roller 32*a* doubles as a driving roller and a second transfer backup roller, the support roller 32*c* is a tension applying roller, the support rollers 32*d* and 32*e* are surface shaping rollers, and the support roller 32*b* is a cleaning backup roller. Further, the belt cleaner 36 has components such as a cleaning member 36*a* and a rotary transport member 36*b* that are disposed inside the housing of the belt cleaner 36. The cleaning member 36*a*, which is an elastic plate or the like, comes into contact with the intermediate transfer belt 31 to scrape off unnecessary substances such as residual toner. The rotary transport member 36*b*, which is a screw auger or the like, sends out the residual toner scraped off by the cleaning member 36*a* toward the developer collection box 6 as waster toner.

The paper feeder 40 is disposed below the four image forming devices 20 (Y, M, C, and K). The paper feeder 40 according to Exemplary Embodiment 1 includes a paper storage body 41 and a sending device 43. The paper storage body 41, which is mounted on the housing 10 in a manner that allows the paper storage body 41 to be freely drawn out, stores the recording paper 9 of a desired size, type, or the like in a state in which sheets of the recording paper 9 are stacked on a stacking plate 42. The sending device 43 sends out the recording paper 9 from the paper storage body 41 sheet by sheet. In the paper feeder 40, at the time of forming an image, the recording paper 9 is sent out by the sending device 43 sheet by sheet as necessary from the paper storage body 41. The recording paper 9 sent out from the paper feeder 40 travels along the transport path indicated by the alternate long and short dash line. Then, the recording paper 9 is finally sent to the second transfer position (between the intermediate transfer belt 31 and the second transfer device 35) of the intermediate transfer device 30, in synchronism with the timing of second transfer by a pair of transport timing control rollers 44 disposed in the transport path.

In the intermediate transfer device 30, at the time of forming an image, toner images of various colors formed on the respective photoconductor drums 21 of the image forming devices 20 (Y, M, C, and K) are sequentially transferred for first transfer to the peripheral surface of the intermediate transfer belt 31 by the first transfer device 34 in a state in which the toner images are aligned with the peripheral surface of the intermediate transfer belt 31. At this time, in each of the image forming devices 20 (Y, M, C, and K), the peripheral surface of the photoconductor drum 21 after the first transfer is cleaned by the drum cleaner 26. Subsequently, the intermediate transfer belt 31 transfers the toner image transferred by first transfer, to the second transfer position located opposite to the second transfer device 35. Thereafter, the intermediate transfer device 30 transfers the toner image on the intermediate transfer belt 31 for second transfer to the recording paper 9 that has been supplied to the second transfer position from the paper feeder 40. At this time, in the intermediate transfer device 30, the peripheral surface of the intermediate transfer belt 31 after the second transfer is cleaned by the belt cleaner 36.

The fixing device 45 includes components such as a heat rotating body 46 and a pressure rotating body 47 that are disposed inside the housing of the fixing device 45. The heat rotating body 46, which is in the form of, for example, a roller or a belt, is rotationally driven in a predetermined required direction, and heated by a heating component so that its surface is kept at a predetermined required temperature. The pressure rotating body 47, which is in the form of, for example, a roller or a belt, rotates in response to the rotation of the heat rotating body 46 by coming into contact with the heat rotating body 46 with a predetermined required pressure substantially along the direction of the rotational axis of the heat rotating body 46.

In the fixing device 45, at the time of forming an image, the recording paper 9 with a toner image transferred by second transfer by the intermediate transfer device 30 is sent to the nip part located between the heat rotating body 46 and the pressure rotating body 47. Then, heat and pressure is applied to the recording paper 9, thus fusing and fixing the toner image onto the recording paper 9. The recording paper 9 with the fixed toner image then travels along the transport path indicated by the alternate long and short dash line. The recording paper 9 is transported to the outside of the housing 10 by a pair of eject rollers 48 disposed in the transport path, before being finally output to and stored in the output/storage part 12.

The image forming apparatus 1 is able to form a color image made with a combination of all or some of the four colors (Y, M, C, and K) of toners, by selectively activating all or some (two or more) of the image forming devices 20 (Y, M, C, and K). Further, the image forming apparatus 1 is also able to form a monochrome image made with a single color of toner such as black, by activating one of the image forming devices 20 (Y, M, C, and K).

<Configuration related to Collection of Developer in Image Forming Apparatus>

In the image forming apparatus 1, as illustrated in FIG. 2 and the like, after developer to be collected is scrapped off and removed by the drum cleaner 26 of each of the four image forming devices 20 (Y, M, C, and K) and by the belt cleaner 36 of the intermediate transfer device 30, the developer is finally collected into the developer collection box 6 that is a single removable developer collection box. Although the above-mentioned developer to be collected is mostly toner, strictly speaking, the developer to be collected also includes residual deposits such as paper dust.

As illustrated in FIGS. 1, 3, and the like, the image forming apparatus 1 according to Exemplary Embodiment 1 has, in one side face portion 10*b* of the housing 10, an installation part 10*f* which is recessed inward and in which the developer collection box is to be installed. The image forming apparatus 1 is used with the developer collection box 6 being removably installed in the installation part 10*f* of the image forming apparatus 1. The side face portion 10*b* of the housing 10 is typically a side face portion where the four image forming devices 20 and the intermediate transfer device 30 can be partially exposed to the outside. For example, the side face portion 10*b* is the front face portion that the user of the image forming apparatus 1 faces when using the image forming apparatus 1. The installation part 10*f* is covered up by an openable exterior cover (not illustrated) constituting a part of the housing 10. Further, the installation part 10*f* has an upper support part 13 provided in a part of its upper end portion. At the time of installing the developer collection box 6, a part of the upper portion of the developer collection box 6 is removably supported by the upper support part 13. Further, the installation part 10*f* has a lower support part 14 provided in a part of its lower end portion. The lower support part 14 supports a part of the lower end portion of the developer collection box 6 in a manner that allows this supported part to also serve as a pivot for swinging motion during installation/removal of the developer collection box 6.

As illustrated in FIG. 4 and the like, in the image forming apparatus 1, in order to transport developer scrapped off and removed by the drum cleaners 26 and the belt cleaner 36 to the developer collection box 6 installed in the installation part 10*f* to discharge the developer, developer discharge pipes 15 (Y, M, C, and K) for the drum cleaners 26 and a developer discharge pipe 16 for the belt cleaner 36 are provided so as to project into the space inside the installation part 10*f*.

Figure 5:
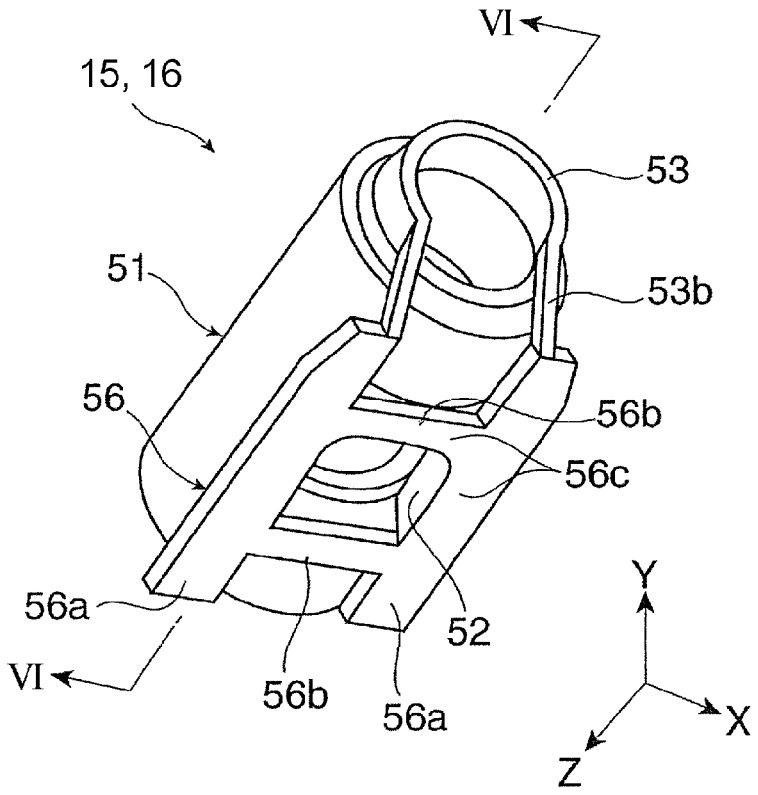
FIG. 5 is a perspective view, as seen from diagonally below, of a developer discharge pipe that projects into the space inside an installation part for the developer collection box on the image forming apparatus illustrated in FIG. 1.
Figure 6:
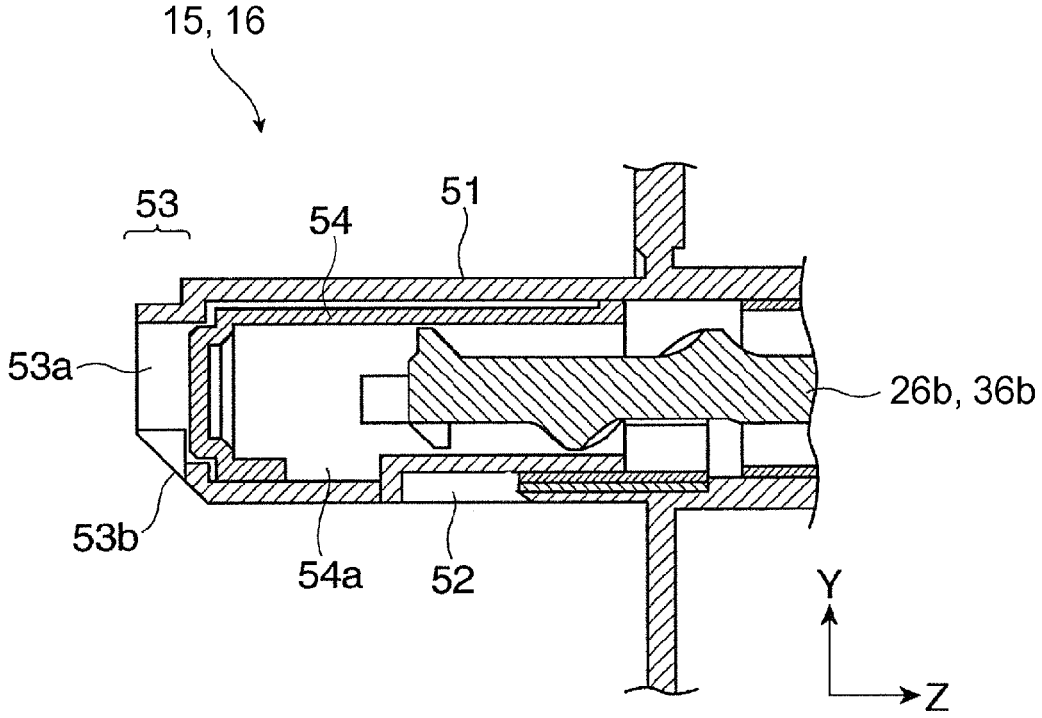
FIG. 6 is a sectional view of the developer discharge pipe (with a discharge opening being closed) taken along a line VI-VI in FIG. 5.

As illustrated in FIGS. 5, 6, and the like, each of the developer discharge pipes 15 (Y, M, C, and K) and 16 is roughly made up of a pipe body 51 and a slide shutter 54. The pipe body 51, which has a cylindrical shape, is provided with a discharge opening 52 through which developer to be collected is discharged. The slide shutter 54 slides in the longitudinal direction of the developer discharge pipe 15 or 16 inside the pipe body 51 to open or close the discharge opening 52.

Of these components, the pipe body 51 is extended so as to reach the space inside the installation part 10*f* from the housing of each of the drum cleaners 26 and the belt cleaner 36. The rotary transport member 26*b* or 36*b* of the drum cleaner 26 or the belt cleaner 36 is rotatably disposed in the space inside the pipe body 51. The rotary transport member 26*b* or 36*b* is extended so as to reach at least the discharge opening 52. The pipe body 51 has a small-diameter part 53 at its distal end side. The small-diameter part 53, which has a diameter smaller than the outside diameter of the pipe body, has an opening 53*a* provided in its distal end portion. The discharge opening 52 is an opening through which developer transported by the rotary transport member 26*b* or 36*b* of each of the drum cleaners 26 or the belt cleaner 36 is dropped and discharged. The discharge opening 52, which has a rectangular shape, is provided in a lower surface portion at the distal end side of the pipe body 51. Incidentally, the lower corner portion of the small-diameter part 53 is formed as an inclined part 53*b* that is beveled. The inclined part 53*b* is inclined progressively toward the back side of the pipe body 51 as the inclined part 53*b* extends downward (see FIGS. 5, 6, and the like).

The slide shutter 54 is a cylindrical structure that is so sized as to fit in the internal space of the pipe body 51. The slide shutter 54 is open in one end portion (the end portion at the back side: the end portion located in the direction of the arrow of the coordinate axis Z). An opening 54*a* is formed in a lower surface of the other end portion (the end portion at the front side) of the slide shutter 54. The slide shutter 54 is fitted into the pipe body 51 in such a way that the slide shutter 54 is able to slide within a predetermined required range along the longitudinal direction of the developer discharge pipe by use of a guide groove and a protrusion (not illustrated) formed between the slide shutter 54 and the pipe body 51. Furthermore, the slide shutter 54 is elastically pressed onto the small-diameter part 53 side of the pipe body 51 by an elastic pressure applying component such as a spring (not illustrated).

When the developer discharge pipe 15 (16) is not connected with the developer collection box 6, the slide shutter 54 is kept in a state in which the slide shutter 54 is abutted and elastically pressed against the small-diameter part 53 of the pipe body 51. In this state, the slide shutter 54 is held in a position that closes the discharge opening 52, with its barrel part (the non-open part of the slide shutter 54 other than the opening 54*a*) being opposed to the discharge opening 52 (see FIG. 6 and the like). When the developer discharge pipe 15 (16) is connected with the developer collection box 6, the slide shutter 54 is kept in a state in which the slide shutter 54 is pushed by a protrusion (67) described later, which is provided in the developer collection box 6, causing the slide shutter 54 to be slid and pushed in toward the back of the pipe body 51. In this state, the slide shutter 54 is held in a position that opens the discharge opening 52, with the opening 54*a* facing the discharge opening 52 (see FIG. 15 and the like).

As illustrated in FIG. 5, in the pipe body 51, a sliding frame 56 is provided around the discharge opening 52. The sliding frame 56 has a pair of elongated plate parts 56*a*, which is located on each side of the discharge opening 52 so as to sandwich the discharge opening 52 and extends in the longitudinal direction of the pipe body 51 to reach the small-diameter part 53, and a coupling part 56*b*, which is located on each side of the discharge opening 52 so as to sandwich the discharge opening 52 and connects the pair of elongated plate parts 56*a*. Respective lower surfaces (areas that come into contact with a sealing member described later) 56*c* of the elongated plate part 56*a* and coupling part 56*b* of the sliding frame 56 are formed as smooth surfaces that are contiguous with each other. Further, the distal end of the elongated plate part 56*a* of the sliding frame 56 is connected with the lower end of the inclined part 53*b* of the small-diameter part 53 of the pipe body 51 (see FIG. 5).

<Configuration of Developer Collection Box>

Figure 7:
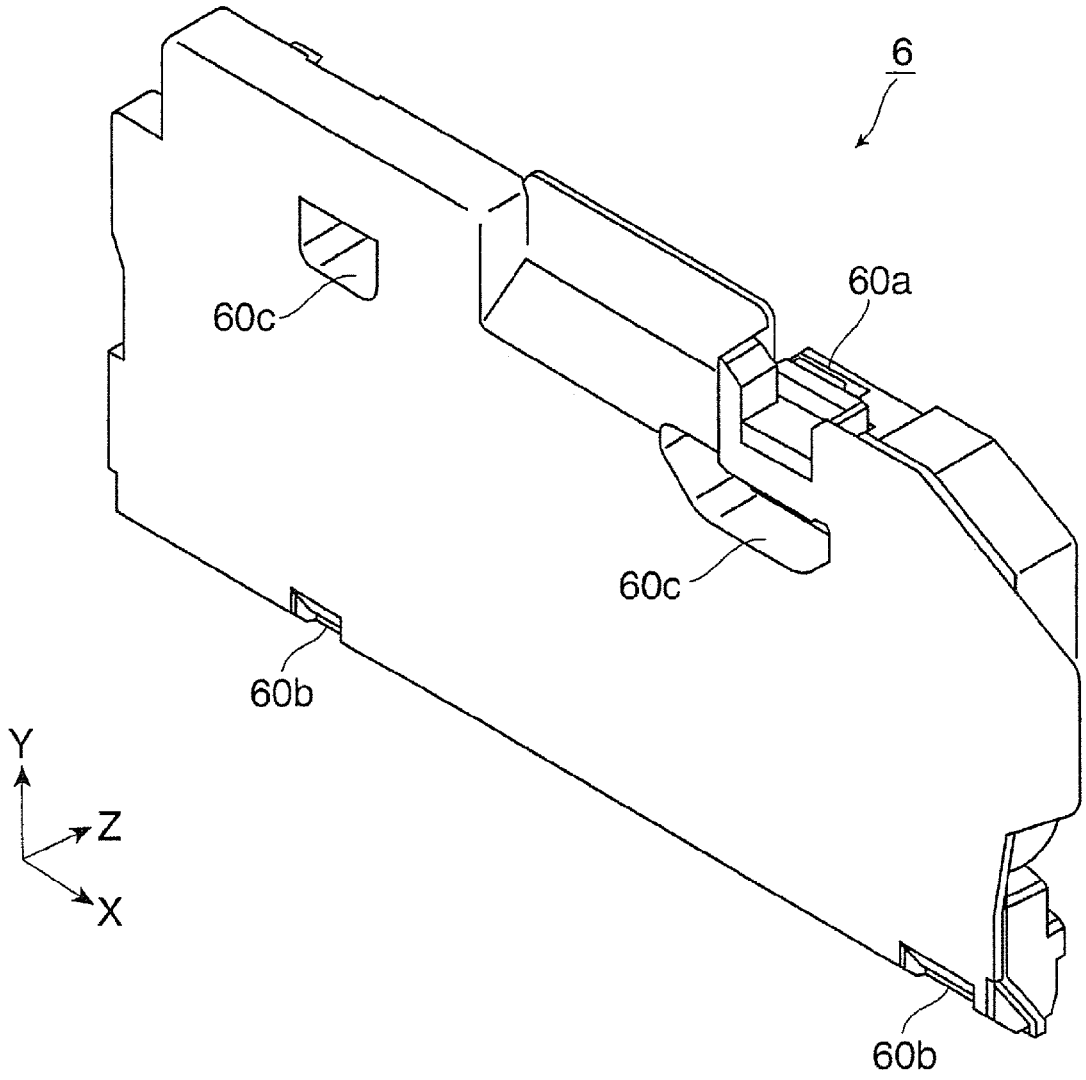
FIG. 7 is a perspective view, as seen from the front side, of the developer collection box according to Exemplary Embodiment 1 which is installed onto the image forming apparatus illustrated in FIG. 1.
Figure 8:
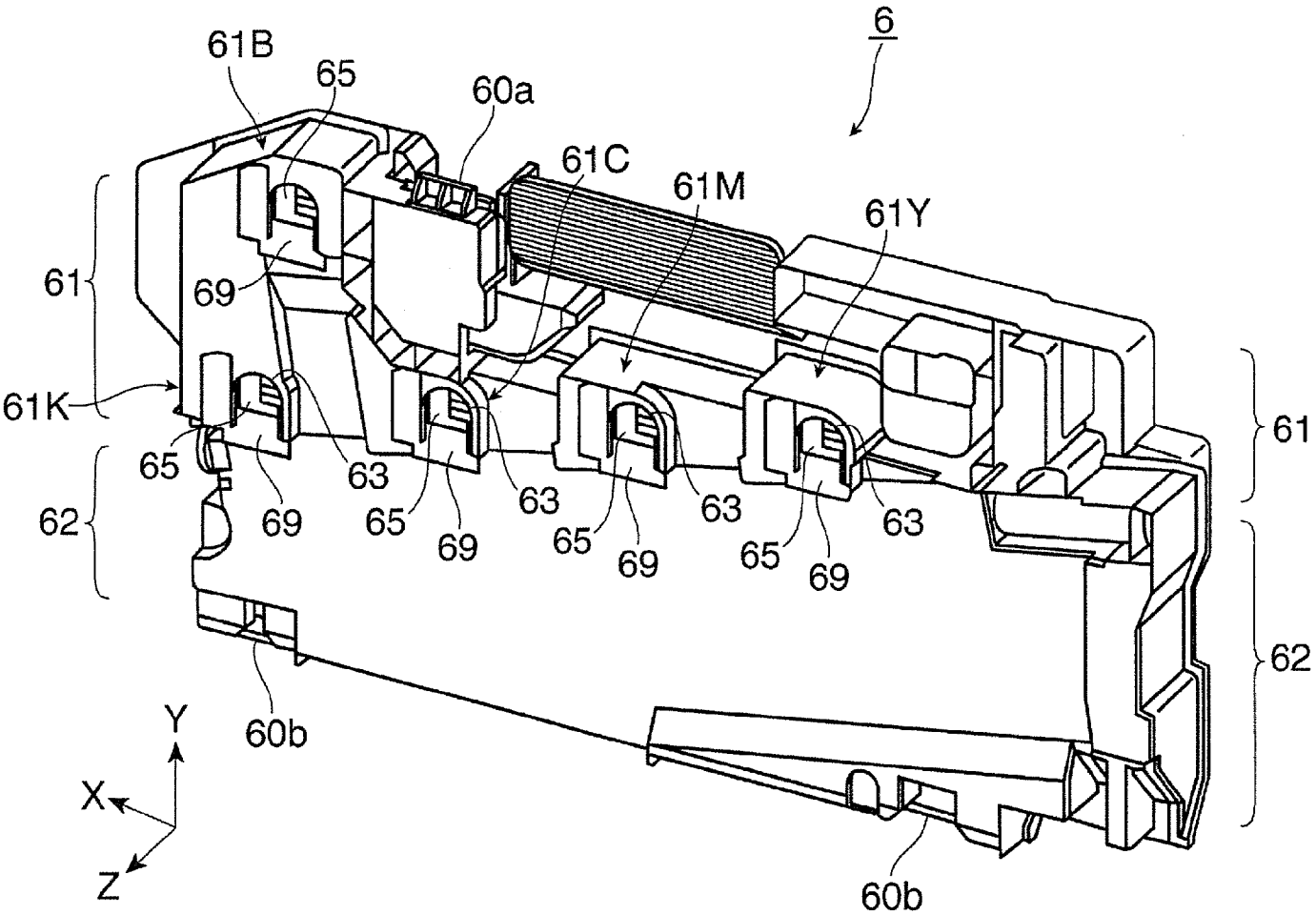
FIG. 8 is a perspective view, as seen from the back side, of the developer collection box illustrated in FIG. 7.
Figure 9:
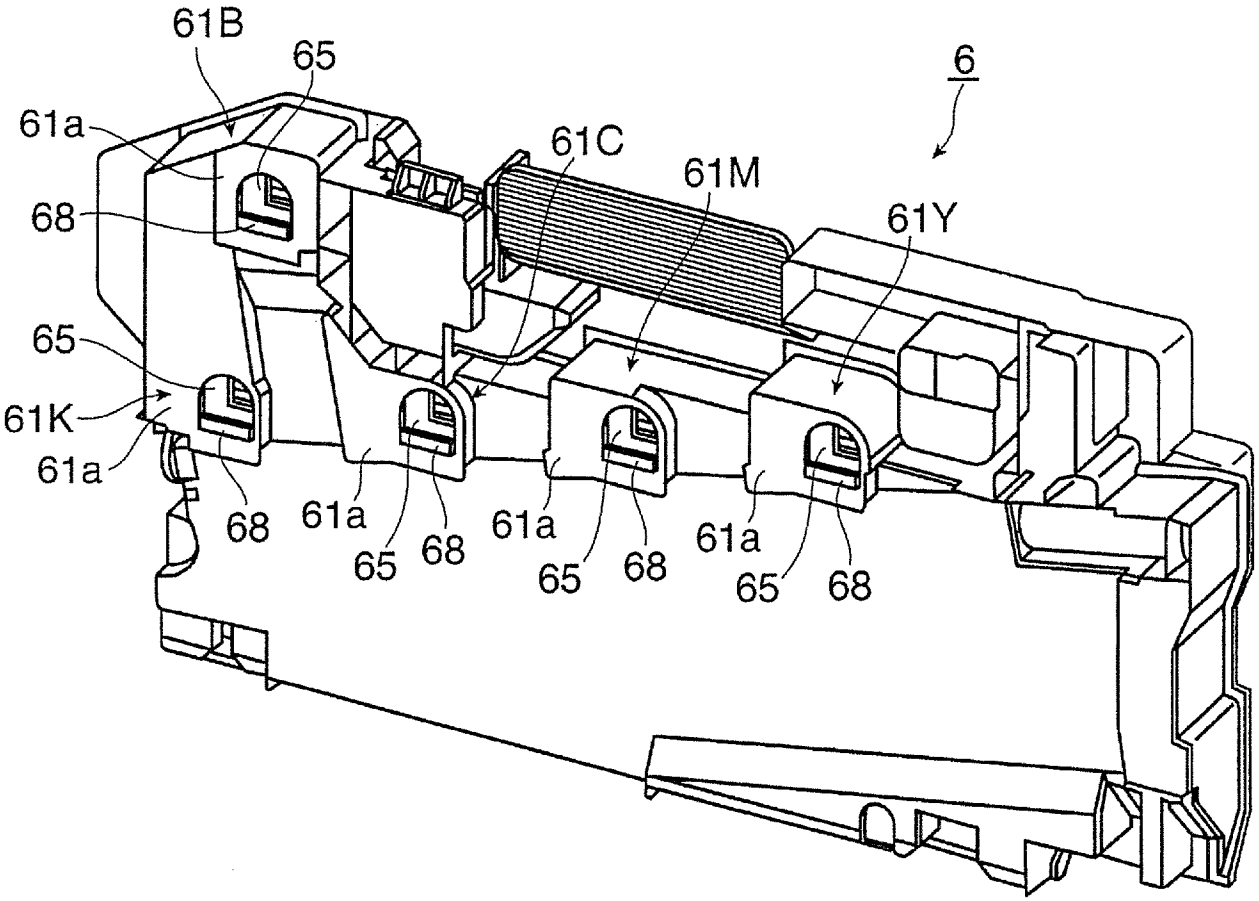
FIG. 9 is a perspective view of the developer collection box illustrated in FIG. 8 with a protective member being removed.
Figure 10:
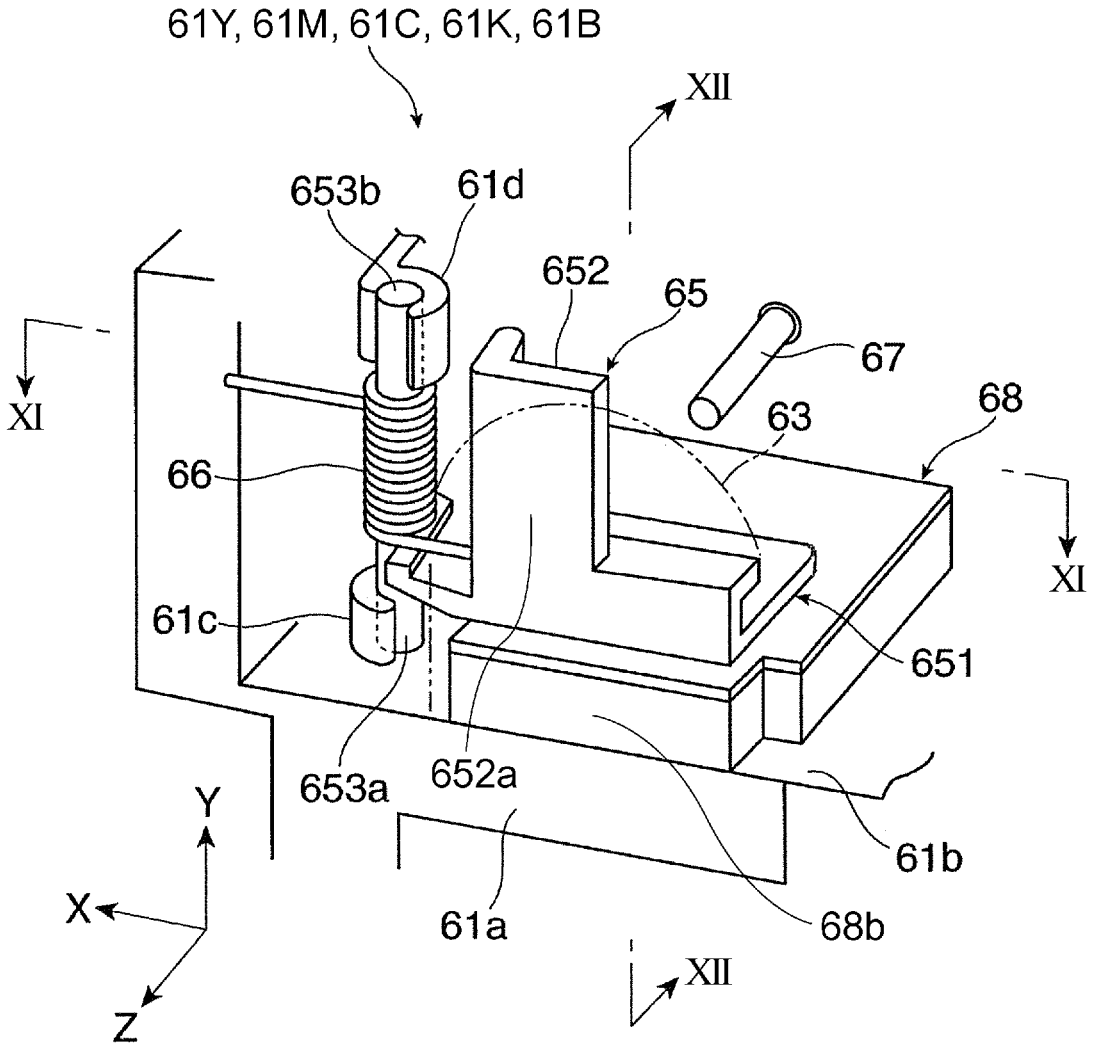
FIG. 10 is a partially see-through perspective view of a major portion of the connecting part of the developer collection box illustrated in FIG. 9.

As described above, the developer collection box 6 is used to collect and store developer scraped off and removed by the drum cleaner 26 of each of the image forming devices (Y, M, C, and K) and the belt cleaner 36 of the intermediate transfer device 30. Specifically, as illustrated in FIGS. 7, 8, and the like, the developer collection box 6 is a container with a predetermined required space provided inside the container. The developer collection box 6 as a whole is shaped like a substantially rectangular thick plate that is elongated laterally.

Further, the developer collection box 6 has a protrusion 60*a* provided in a part of its upper end portion. The protrusion 60*a* is releasably supported on the upper support part 13 of the installation part 10*f*. The developer collection box 6 has a lower mounting part 60*b* provided in a part of its lower end portion. The lower mounting part 60*b*, which has a plate-like shape, is swingably supported on the lower support part 14 of the installation part 10*f*. A handle hole 60*c*, which is recessed toward the back side, is provided on the front side of the developer collection box 6. Accordingly, the developer collection box 6 is installed into or removed from the installation part 10*f* of the image forming apparatus 1 as follows.

First, at the time of installing the developer collection box 6 into the installation part 10*f* of the image forming apparatus 1, as illustrated in FIG. 3 and the like, the developer collection box 6 as a whole is tilted into an oblique position, and the lower mounting part 60*b* is inserted into the lower support part 14 of the installation part 10*f*. Thereafter, by swinging the developer collection box 6 about the lower mounting part 60*b*, which has a plate-like shape and is located in the lower end portion of the developer collection box 6, so as to raise the developer collection box 6, the protrusion 60*a* located in the upper end portion of the developer collection box 6 is supported and locked onto the upper support part 13 of the installation part 10*f*. In this way, the developer collection box 6 is mounted in the installation part 10*f* (see FIG. 1).

To remove the developer collection box 6 from the installation part 10*f* of the image forming apparatus 1, the locking of the protrusion 60*a*, which is located in the upper end portion of the developer collection box 6, on the upper support part 13 of the installation part 10*f* is released. Then, the upper end portion of the developer collection box 6 is pulled forward to swing the developer collection box 6 as a whole into an obliquely tilted position (see FIG. 3). Thereafter, the developer collection box 6 as a whole is lifted obliquely forward to pull the lower mounting part 60*b* out of the lower support part 14 of the installation part 10*f*. The developer collection box 6 is thus removed from the installation part 10*f* (see FIG. 4).

As illustrated in FIG. 8 and the like, the developer collection box 6 has a connecting part 61 provided in its upper portion. The connecting part 61 is provided to connect the developer collection box 6 to the developer discharge pipe 15 (Y, M, C, or K) of each of the drum cleaners 26 and to the developer discharge pipe 16 of the belt cleaner 36 at the time of installing the developer collection box 6 into the installation part 10*f* of the image forming apparatus 1. Further, a storage part 62 is provided in a lower portion of the developer collection box 6, below the connecting part 61 (below the connecting part 61 in the direction of gravity). The storage part 62 has a space into which developer discharged from the discharge opening 52 of each of the developer discharge pipe 15 (Y, M, C, or K) and the developer discharge pipe 16 is finally stored.

The connecting part 61 has four connecting parts 61Y, 61M, 61C, and 61K for connection to the developer discharge pipes 15 (Y, M, C, and K) of the drum cleaners 26, respectively, and a connecting part 61B for connection to the developer discharge pipe 16 of the belt cleaner 36. Since the image forming devices 20 (Y, M, C, and K) are disposed side by side in an inclined manner as described above, the four connecting parts 61Y, 61M, 61C, and 61K are also disposed side by side in an inclined manner at positions corresponding to the positions where the image forming devices 20 (Y, M, C, and K) are disposed, respectively. Further, the connecting part 61B is disposed at a position (for example, obliquely above the connecting part 61K) corresponding to the position where the developer discharge pipe 16 of the belt cleaner 36 is disposed.

As illustrated in FIGS. 8 to 12 and the like, each of the connecting parts 61 (Y, M, C, and K) and 61B is a structural part having a containment space (S), which is a space into which the pipe body 51 of the developer discharge pipe 15 or 16 is inserted to be contained. Each of the connecting parts 61 (Y, M, C, and K) and 61B has a connection opening 63 in an end portion 61*a*, which is an area at the back side of the developer collection box 6. The connection opening 63 is provided to allow insertion of the developer discharge pipe 15 or 16 into the containment space (S). The connection opening 63 is formed in the shape of an opening whose upper portion has a semi-circular shape and whose lower portion has a rectangular shape. The bottom edge portion of the connection opening 63 is located at the same position as the surface of a bottom portion (61*b*) where a receiving opening (64) described later is provided (see FIGS. 10, 12, and the like).

Further, each of the connecting parts 61 (Y, M, C, and K) and 61B has the receiving opening 64 provided in the bottom portion 61*b* (which also serves as a partition plate for partitioning the connecting part 61 from the storage part 62) inside the containment space (S). The receiving opening 64 receives developer discharged and dropped from the discharge opening 52 of the developer discharge pipe 15 or 16. The receiving opening 64 is located so as to face the discharge opening 52 of the developer discharge pipe 15 or 16 when the developer discharge pipe 15 or 16 is connected with the connecting part 61. The receiving opening 64 is formed in, for example, a rectangular shape. Substantially the entire region of the bottom portion 61*b* including the area around the receiving opening 64 is formed as a smooth surface.

Further, in each of the connecting parts 61 (Y, M, C, and K) and 61B, a rotary shutter 65 is provided in the bottom portion 61*b* where the receiving opening 64 is provided. The rotary shutter 65 rotationally moves in parallel to the bottom portion 61*b* in conjunction with relative movement of the connecting part 61 with respect to the developer discharge pipe 15 or 16, thereby opening and closing the receiving opening 64.

The rotary shutter 65 has a covering part 651 that covers and closes the receiving opening 64, an abutment part 652 against which the developer discharge pipe 15 or 16 (the small-diameter part 53 of the pipe body 51) abuts during installation of the developer collection box 6, and a shaft part 653 that rotatably supports the covering part 651 and the abutment part 652.

The covering part 651 is a plate-like part having a lower surface 651*a* that is substantially parallel to the bottom portion 61*b*. The covering part 651 as a whole has such dimensions that allow the covering part 651 to cover up the receiving opening 64. The abutment part 652 is provided in an end portion of the covering part 651 which sometimes comes to face the connection opening 63. Abutment of the developer discharge pipe 15 or 16 against the abutment part 652 causes the rotary shutter 65 to rotationally move. The abutment part 652 has, for example, an abutment surface 652*a* that is partially in contact with the inner wall surface on the back side of the connection opening 63 of the connecting part 61, and is L-shaped as a whole. The shaft part 653 is provided in one corner portion on the plane in which the covering part 651 is formed or in the vicinity of the corner portion. The shaft part 653 is formed in the shape of a round bar that rises upward substantially perpendicularly (in the direction of gravity in Exemplary Embodiment 1) from (the lower surface 651*a* of the covering part 651 of) the bottom portion 61*b*.

A lower portion 653*a* and an upper portion 653*b* of the shaft part 653 of the rotary shutter 65 are rotatably mounted on a bearing part 61*c* located in the bottom portion 61*b* of the connecting part 61 and to a bearing part 61*d* located in an upper portion of the containment space (S), respectively. Further, (a coil part of) a torsion spring 66 is mounted on the middle portion of the shaft part 653 of the rotary shutter 65. The torsion spring 66 applies a rotational force that causes the covering part 651 of the rotary shutter 65 to rotationally move to a position for closing the receiving opening 64. When the developer collection box 6 is not installed in the installation part 10*f*, the spring force of the torsion spring 66 keeps a part (for example, an upper end portion) of the abutment part 652 of the rotary shutter 65 pressed against the inner wall surface located on the back side of the connection opening 63 of the connecting part 61.

Accordingly, as illustrated in FIGS. 10 to 13, and the like, when the developer collection box 6 is not installed in the installation part 10*f*, the rotary shutter 65 is pushed by the spring force of the torsion spring 66, thus keeping the covering part 651 in a position that closes the receiving opening 64. Further, as illustrated in FIGS. 14, 15, and the like, during installation of the developer collection box 6 into the installation part 10*f*, owing to relative movement of the developer collection box 6 with respect to the developer discharge pipe 15 or 16, the developer collection box 6 is pushed so as to resist the spring force of the torsion spring 66. Consequently, the developer collection box 6 rotationally moves about the shaft part 653, causing the covering part 651 to be kept in a position that opens the receiving opening 64. The rotational movement of the rotary shutter 65 about the shaft part 653 extending along the vertical direction causes the covering part 651 to be displaced substantially in parallel to the bottom portion 61*b* of the connecting part 61.

Further, in each of the connecting parts 61 (Y, M, C, and K) and 61B, the protrusion 67 is provided in a part of an inner wall surface 61*e* inside the containment space (S) which is opposed to the connection opening 63. The protrusion 67 is provided to push the slide shutter 54 of the developer discharge pipe 15 or 16.

The protrusion 67 is located so as to be opposed to the opening 53*a* of the small-diameter part 53 of the developer discharge pipe 15 or 16 inserted into the containment space (S) of the connecting part 61. Further, the protrusion 67 is in the form of a bar having such dimensions (thickness and length) that, during installation of the developer collection box 6 into the installation part 10*f*, allow the protrusion 67 to fit into the pipe body 51 from the opening 53*a* of the small-diameter part 53, and then push the slide shutter 54 to a position that opens the discharge opening 52 (see FIGS. 14 and 15).

The storage part 62 has a storage space capable of storing a predetermined required amount of developer discharged and dropped from the discharge opening 52 of the developer discharge pipe 15 or 16. The storage space is formed as a single space that is connected with the receiving opening 64 of each of the connecting parts 61 (Y, M, C, and K) and 61B. Further, components described below are disposed in the storage part 62. These components include a rotary transport member (not illustrated), which is used to minimize uneven deposition of developer stored in the storage space, and a detector (not illustrated), which detects if the amount of developer stored in the storage space has reached an amount set as a guide for the timing to replace the developer collection box 6.

Further, as illustrated in FIGS. 10 to 16B, and the like, in the developer collection box 6, a sealing member 68 is provided in the bottom portion 61*b* of the connecting part (Y, M, C, K, or B) where the receiving opening 64 is provided. The sealing member 68 seals a gap that is formed between the covering part 651 and the bottom portion 61*b* when the rotary shutter 65 is in a position that closes the receiving opening 64, and also seals a gap that is formed between the surrounding part (the sliding frame 56) of the discharge opening 52 and the bottom portion 61*b* when the developer discharge pipe 15 or 16 is connected with the connecting part 61.

The gap formed between the covering part 651 and the bottom portion 61*b* at this time is a space that is present between the covering part 651 and the bottom portion 61*b* if the sealing member 68 is removed in FIGS. 10, 12, 16A, 16B, and the like. Likewise, the gap formed between the surrounding part of the discharge opening 52 and the bottom portion 61*b* is a space that is present between the surrounding part of the discharge opening 52 and the bottom portion 61*b* if the sealing member 68 is removed in FIGS. 15, 16A, 16B, and the like.

As described above, in Exemplary Embodiment 1, the developer collection box 6 is of a type which is installed into the installation part 10*f* by swinging the developer collection box 6 about the lower mounting part 60*b* located in its lower end portion. Accordingly, after moving along an arcuate trajectory, the connecting part 61 (Y, M, C, K, or B) of the developer collection box 6 is connected to the developer discharge pipe 15 or 16, which is secured in place in the installation part 10*f* so as to project substantially horizontally, in such a manner that the connecting part 61 (Y, M, C, K, or B) and the developer discharge pipe 15 or 16 are substantially horizontal and parallel to each other. Consequently, each of the gaps mentioned above is set to a somewhat large distance, with a view to securing (particularly on the side of the end portion of the connecting part 61 which is provided with the connection opening 63) an arcuate trajectory for the connecting part 61 during installation (including removal) of the developer collection box 6 to realize smooth installation and removal of the developer collection box 6.

Figure 11:
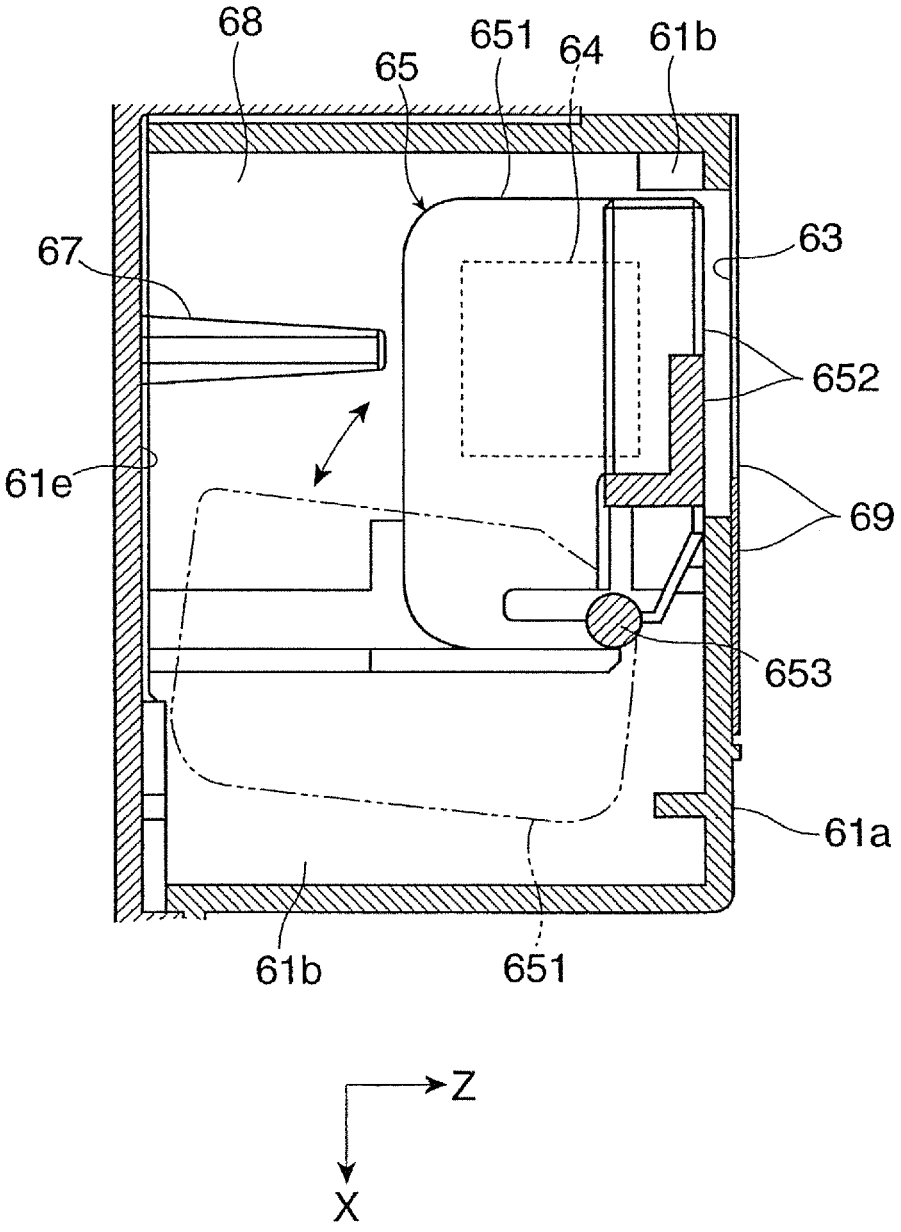
FIG. 11 is a schematic sectional view taken along a line XI-XI of the connecting part illustrated in FIG. 10.
Figure 13:
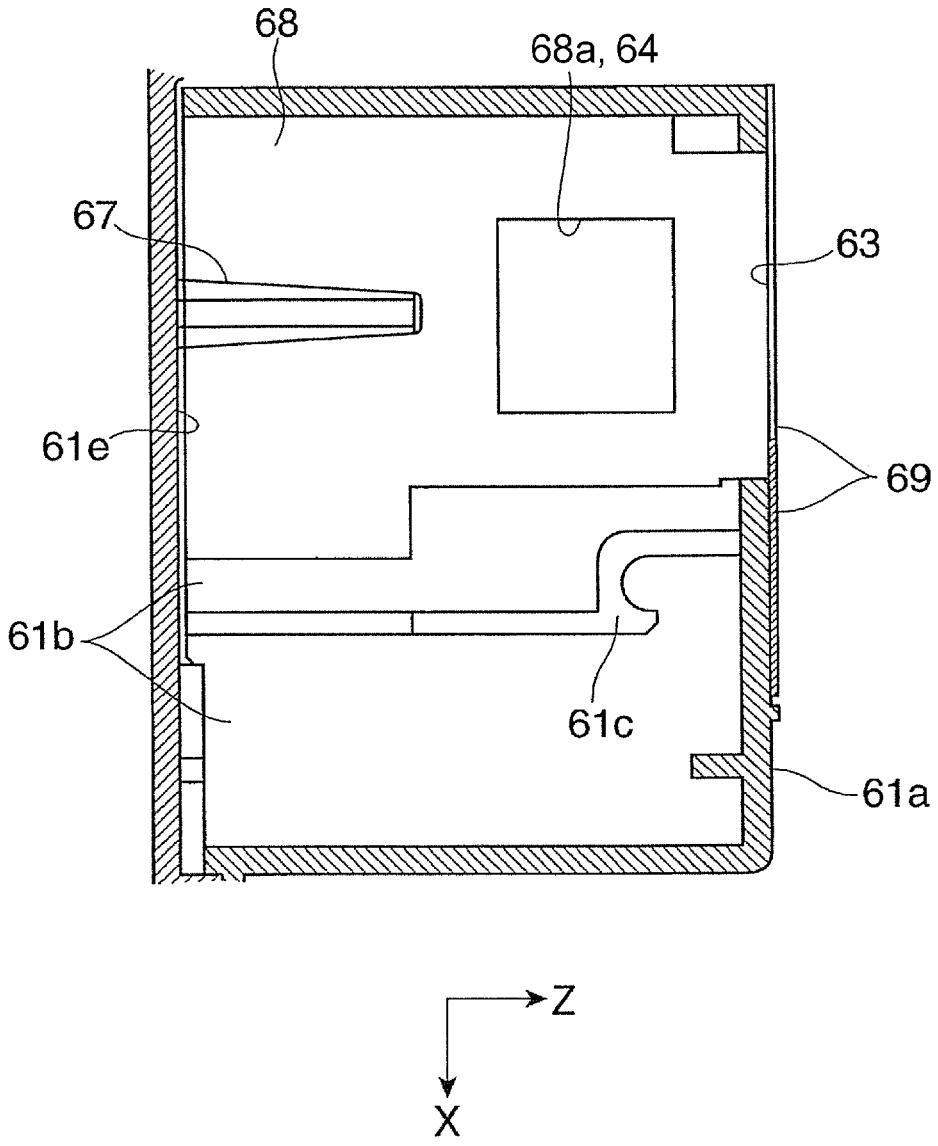
FIG. 13 is a schematic sectional view of the connecting part illustrated in FIG. 11 with a rotary shutter being removed.
Figure 14:
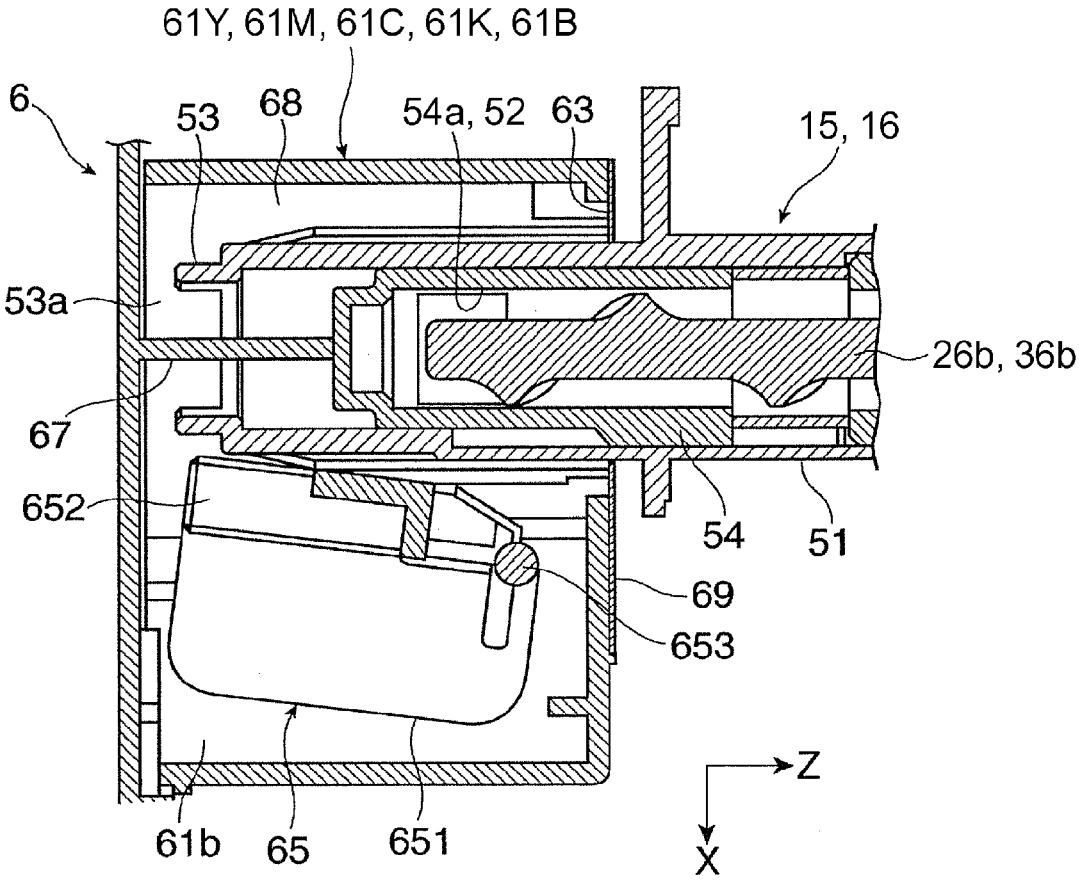
FIG. 14 is a schematic sectional view illustrating a state in which the developer discharge pipe is connected with the connecting part of the developer collection box illustrated in FIG. 11.
Figure 15:
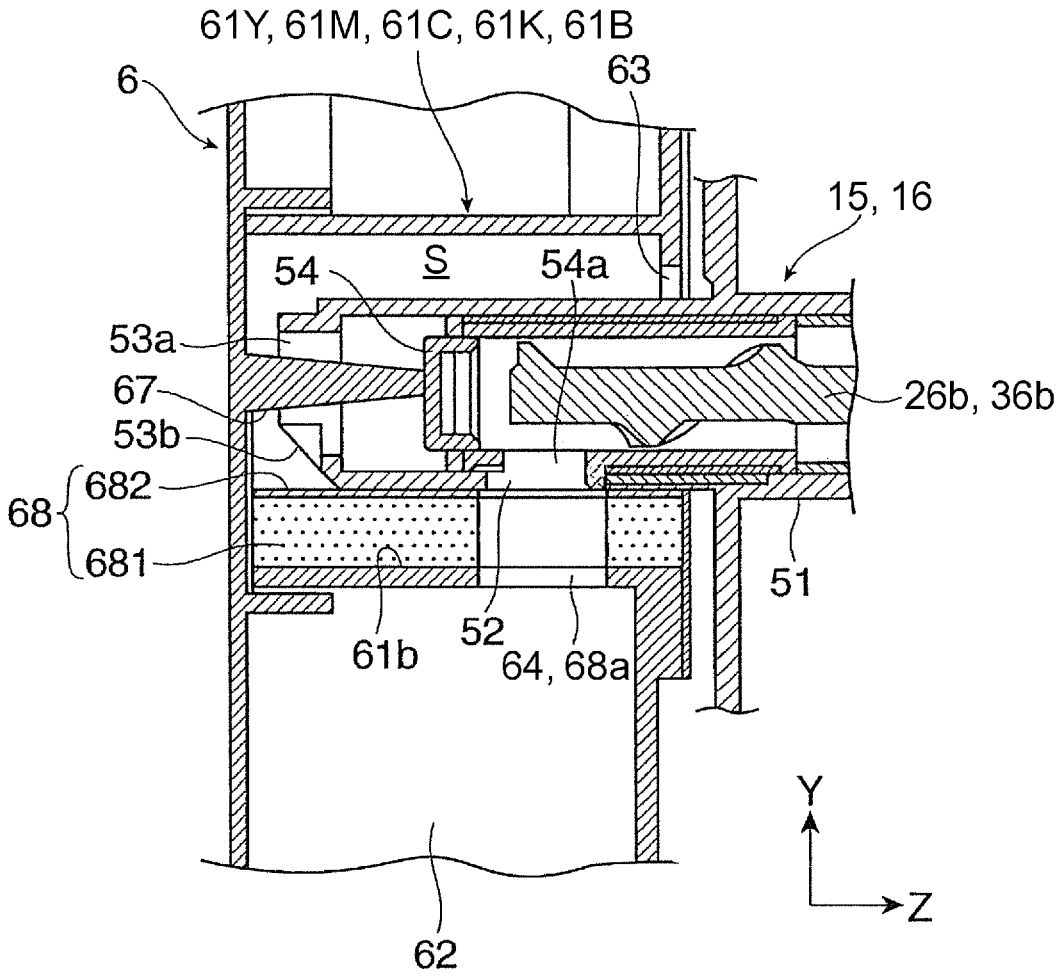
FIG. 15 is a schematic sectional view illustrating a state in which the developer discharge pipe is connected with the connecting part of the developer collection box illustrated in FIG. 12.

As illustrated in FIGS. 11, 13, 14, and the like, the sealing member 68 is provided around the receiving opening 64 in the bottom portion 61*b* of the connecting part 61, so as to include an area that can come into contact with (the lower surface (contact surface) 651*a* of) the covering part 651 when the rotary shutter 65 is in the close position, and with the (lower surface 56*c*) of the sliding frame 56 located around the discharge opening 52 when the developer discharge pipe 15 or 16 is connected with the connecting part 61.

Figure 12:
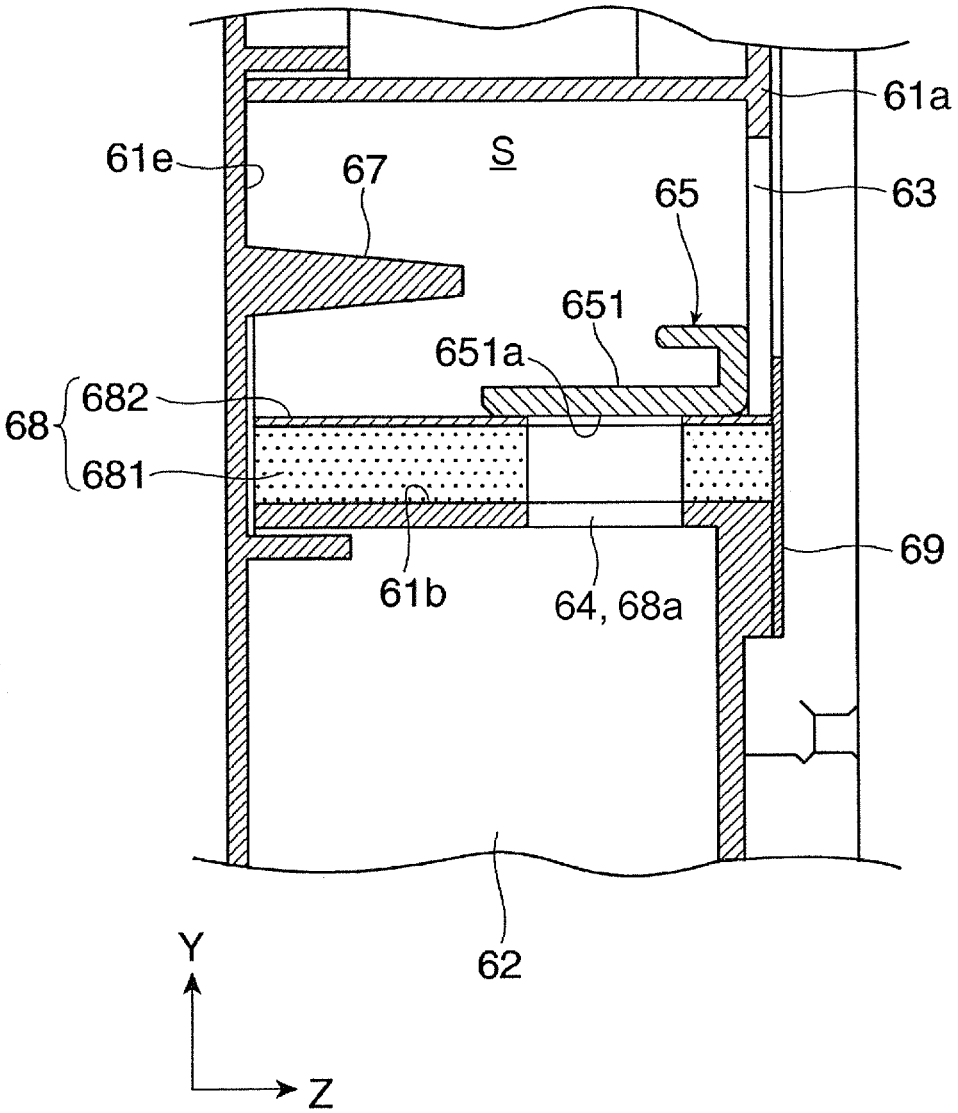
FIG. 12 is a schematic sectional view taken along a line XII-XII of the connecting part illustrated in FIG. 10.

As illustrated in FIGS. 12, 13, and the like, in Exemplary Embodiment 1, the sealing member 68 is disposed so as to form a planar shape that has a length corresponding to the depth from the connection opening 63 of the connecting part 61 to the inner wall surface 61*e* of the containment space (S) opposed to the connection opening 63, and a width that is slightly larger than the dimension along the horizontal direction of the connection opening 63. Further, the sealing member 68 has a through-hole 68*a* provided in an area corresponding to the receiving opening 64. The through-hole 68*a* has a rectangular shape, and contiguously overlaps the receiving opening 64 (see FIGS. 12, 13, and the like). The through-hole 68*a* is a hole having substantially the same shape (size) as that of the receiving opening 64. Therefore, when the presence of the sealing member 68 is taken into consideration, the receiving opening 64 of the connecting part 61 can be also regarded as the through-hole 68*a* of the sealing member 68.

The sealing member 68 has such a thickness that allows the sealing member 68 to fill and seal each of the gaps mentioned above. In the case of using, as the sealing member 68, a member that is elastically deformed into contact with the covering part 651 of the rotary shutter 65 and the surrounding part of the discharge opening 52 of the developer discharge pipe 15 or 16, the thickness of the sealing member 68 is set to a value somewhat larger than the (height) dimension of each of the gaps mentioned above.

Any sealing member capable of sealing each of the gaps mentioned above may be used as the sealing member 68. For example, the sealing member 68 may be made of a material such as a foamed elastic material or felt. The sealing member 68 according to Exemplary Embodiment 1 includes a base 681 in the form of a flat plate made of a material such as a foamed elastic material, and a surface layer 682 made of a material such as felt that is stacked on top of the base 681. The sealing member 68 is adhered to a predetermined required region of the bottom portion 61*b* of the connecting part 61 by use of an adhering component such as adhesive or a doubled-faced adhesive tape. An end face portion 68*b* of the sealing member 68, which is an end face portion located at the position of the connection opening 63 of the connecting part 61, is exposed to the outside (back side) of the developer collection box 6 (see FIGS. 9, 10, and the like).

Figure 16B:
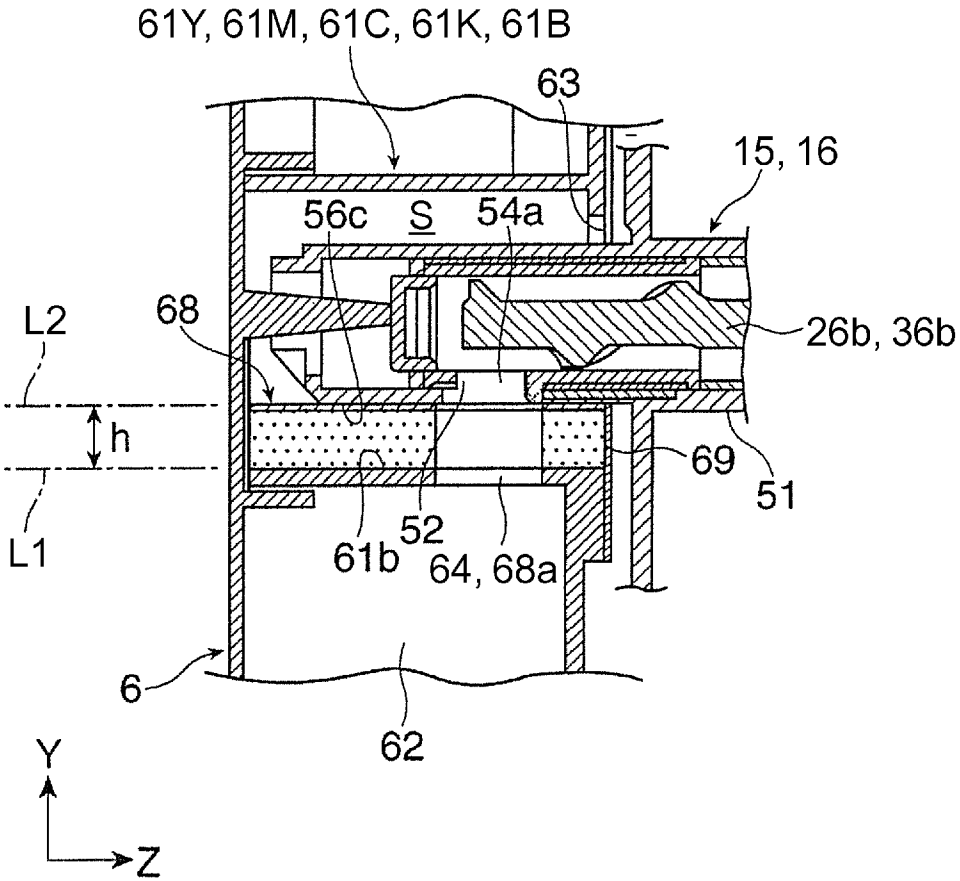
FIG. 16B is a schematic sectional view illustrating a state in which the developer discharge pipe is connected with the connecting part of the developer collection box.
Figure 16A:
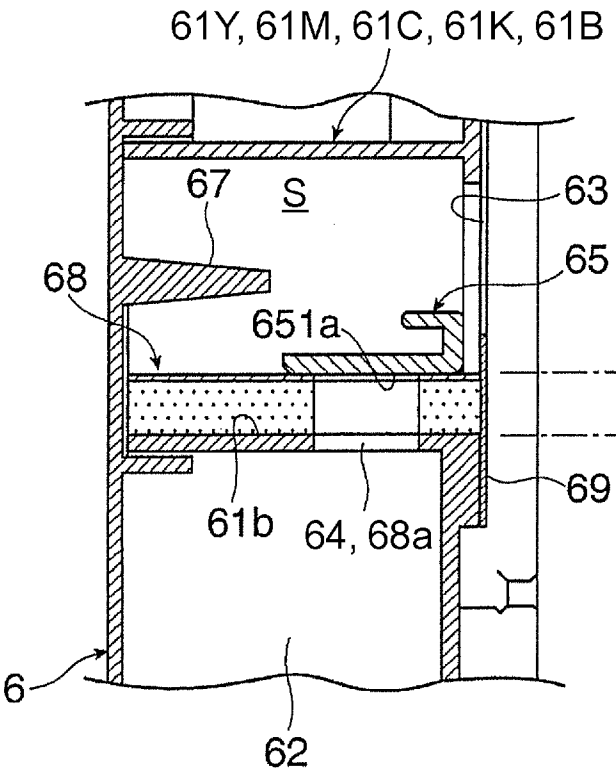
FIG. 16A is a schematic sectional view illustrating a state in which a receiving opening in the connecting part of the developer collection box is closed by the rotary shutter.

In the developer collection box 6, as illustrated in FIGS. 16A and 16B, the gap between the covering part 651 of the rotary shutter 65 and the bottom portion 61*b* of the connecting part 61 has a dimension that is set to the same value (h) as that of the gap between the sliding frame 56 located around the discharge opening 52 of the developer discharge pipe 15 or 16 and the bottom portion 61*b* of the connecting part 61.

Specifically, in a state in which connection of the developer discharge pipe 15 or 16 to the connecting part 61 is complete, the lower surface (contact surface) 651*a* of the covering part 651 of the rotary shutter 65 is at the same height (at the same separation distance from the bottom portion 61*b* as) the lower surface 56*c* of the sliding frame 56 located around the discharge opening 52 of the developer discharge pipe 15 or 16. In Exemplary Embodiment 1, each of the gaps mentioned above has a dimension (h) of, for example, 4.5 mm to 5.5 mm. In FIGS. 16A and 16B, an alternate long and short dash line L1 denotes the height of the bottom portion 61*b* of the connecting part 61, and an alternate long and short dash line L2 denotes the height of (the lower surface (contact surface) 651*a* of) the covering part 651 of the rotary shutter 65 and the height of (the lower surface 56*c* of) the sliding frame 56 located around the discharge opening 52 of the developer discharge pipe 15 or 16.

In addition, as illustrated in FIGS. 7, 11, 12, and the like, the developer collection box 6 has a protective member 69 provided in the end portion 61*a* of the connecting part 61, which is an end portion at the side (back side) of the connecting part 61 through which the developer discharge pipe 15 or 16 passes during relative movement of the connecting part 61 with respect to the developer discharge pipe 15 or 16 (during installation of the developer collection box 6). The protective member 69 covers up and protects the end face portion 68*b*, which is exposed at the position of the end portion 61*a*, of the sealing member 68.

The protective member 69 is a sheet-like elastic member made of a material such as a urethane foam or a polyethylene terephthalate (PET) film. The protective member 69 is provided so as to be able to cover up, for example, the entirety of the end face portion 68*b* of the sealing member 68, and a lower portion of the abutment part 652 of the rotary shutter 65. Further, the protective member 69 is adhered to the end portion 61*a* of the connecting part 61 by use of an adhering component such as a double-faced adhesive tape.

<Use of Developer Collection Box, Etc.>

Next, use of the developer collection box 6, and the like will be described.

As illustrated in FIG. 1, the developer collection box 6 is installed into the installation part 10*f* of the image forming apparatus 1 for use.

First, the developer collection box 6 is installed into the installation part 10*f* as follows. As described above, first, the developer collection box 6 as a whole is tilted into an oblique position so that the lower mounting part 60*b* is inserted into the lower support part 14 of the installation part 10*f* (see FIGS. 3 and 17).

Figure 17:
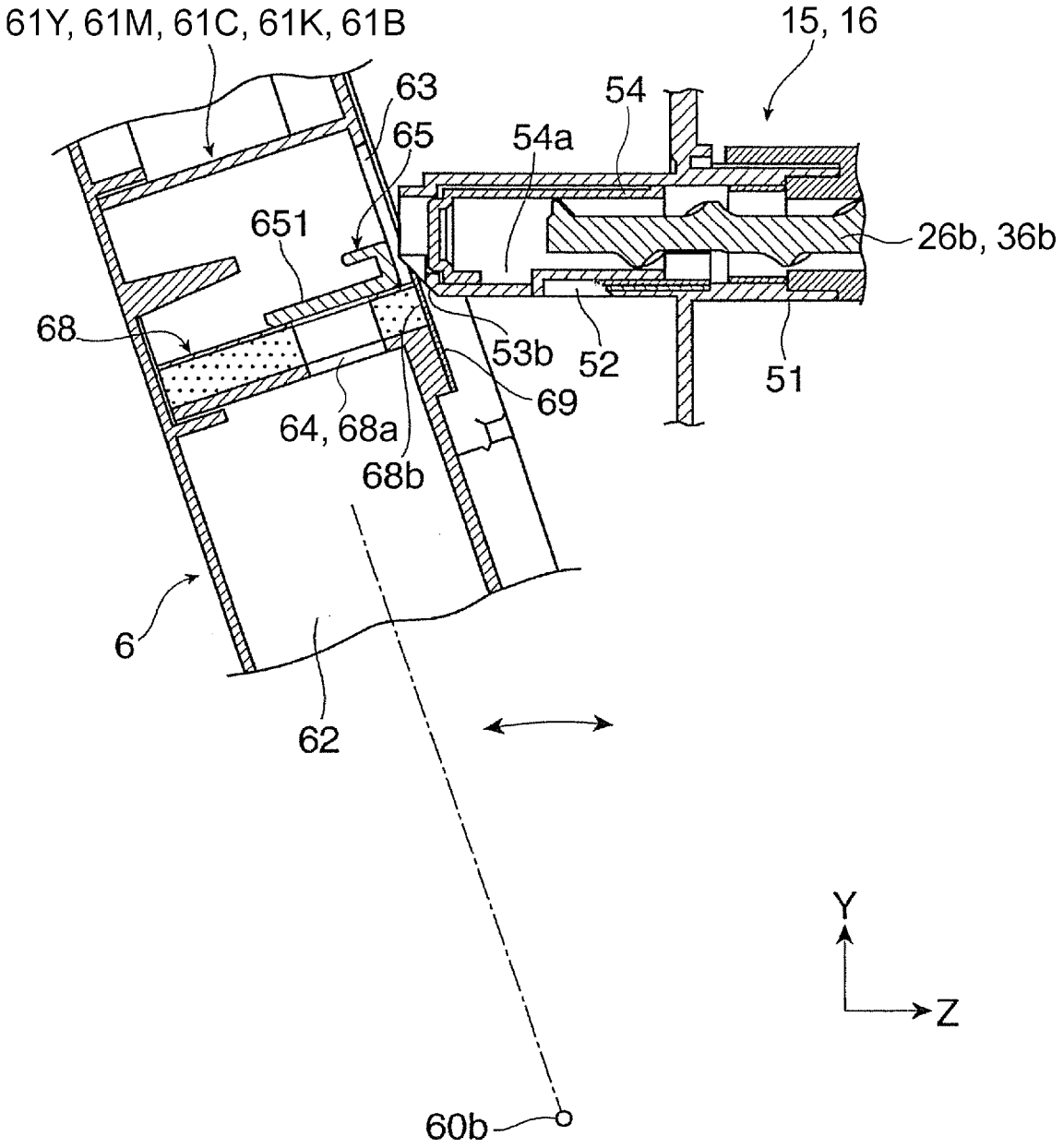
FIG. 17 is a sectional view illustrating a state of the connecting part and the developer discharge pipe during installation/removal (in particular, installation) of the developer collection box.

At this time, as illustrated in FIGS. 11, 12, and 17, in the developer collection box 6, the receiving opening 64 (in actuality, the through-hole 68*a* of the sealing member 68) of each of the connecting parts 61 (Y, M, C, K, and B) is closed by the covering part 651 of the rotary shutter 65. That is, the rotary shutter 65 is displaced to a position that closes the receiving opening 64 and kept in that state, with the lower surface 651*a* of the covering part 651 of the rotary shutter 65 being in contact with the body (the portion excluding the through-hole 68*a*) of the sealing member 68 to close the through-hole 68*a*. At this time, the gap between the surrounding part of the receiving opening 64 in the bottom portion 61*b* of the connecting part 61 and the covering part 651 of the rotary shutter 65 remains sealed by the body of the sealing member 68.

Meanwhile, as illustrated in FIGS. 6, 17, and the like, in each of the developer discharge pipes 15 and 16, the discharge opening 52 of the pipe body 51 is closed by the slide shutter 54. That is, the slide shutter 54 is displaced to a position that closes the discharge opening 52 and kept in that state, with the barrel part of the slide shutter 54 overlapping the discharge opening 52 to close the discharge opening 52. At this time, the rotary transport member 26*b* or 36*b* inside the pipe body 51 remains still without rotating.

Subsequently, the developer collection box 6 is caused to swing about the lower mounting part 60*b* located in its lower end portion, so as to raise the developer collection box 6 toward the installation part 10*f*. Then, as illustrated in FIG. 17 and the like, first, the connection opening 63 of the connecting part 61 (Y, M, C, K, or B) of the developer collection box 6 approaches the distal end portion (the small-diameter part 53 of the pipe body 51) of the developer discharge pipe 15 or 16. Incidentally, during this swinging motion to raise the developer collection box 6 at the time of its installation, the connecting part 61 of the developer collection box 6 approaches the developer discharge pipe 15 or 16 while moving along an arcuate trajectory that is a part of a circle centered at the lower mounting part 60*b*. The connecting part 61 moves along an arcuate trajectory also at the time of swinging the developer collection box 6 so as to tilt the developer collection box 6 down during its removal from the installation part 10*f*.

At this time, the end face portion 68*b* of the sealing member 68, which is exposed in a lower portion of the connection opening 63 of the connecting part 61, becomes opposed to and able to contact the beveled inclined part 53*b* of the small-diameter part 53 located in the distal end portion of the developer discharge pipe 15 or 16.

Figure 18A:
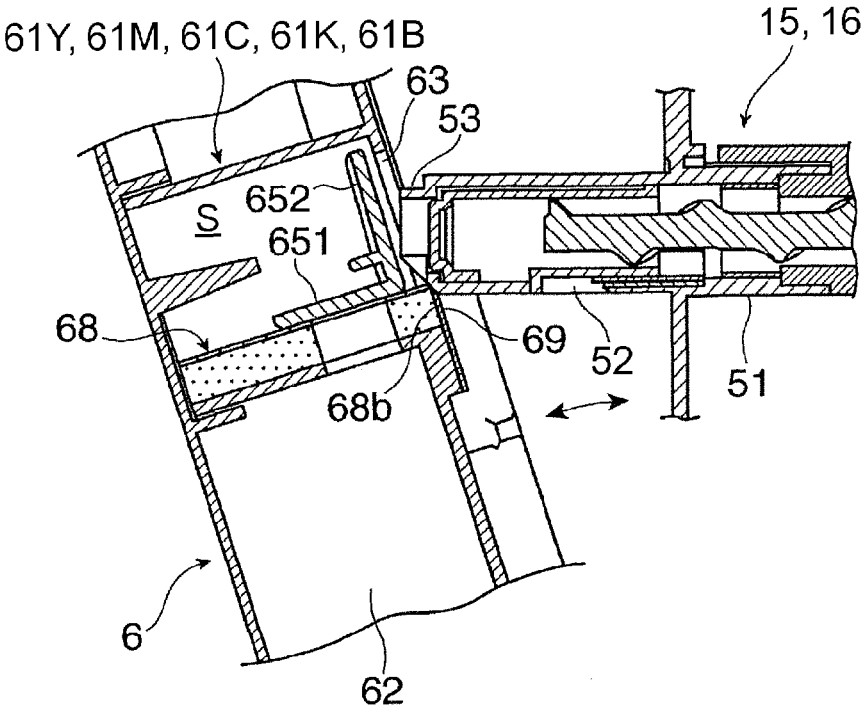
FIG. 18A is a sectional view illustrating a state of the connecting part and the developer discharge pipe at a point in time during installation/removal (in particular, installation) of the developer collection box.

Then, further swinging the developer collection box 6 so as to raise the developer collection box 6 results in the state as illustrated in FIG. 18A. That is, the distal end portion (in actuality, the small-diameter part 53) of the developer discharge pipe 15 or 16 fits slightly into the containment space (S) through the connection opening 63 of the connecting part 61 and becomes abutted against the abutment part 652 of the rotary shutter 65, and also comes into contact with the end face portion 68*b* of the sealing member 68 which is exposed in a lower portion of the connection opening 63.

Figure 18B:
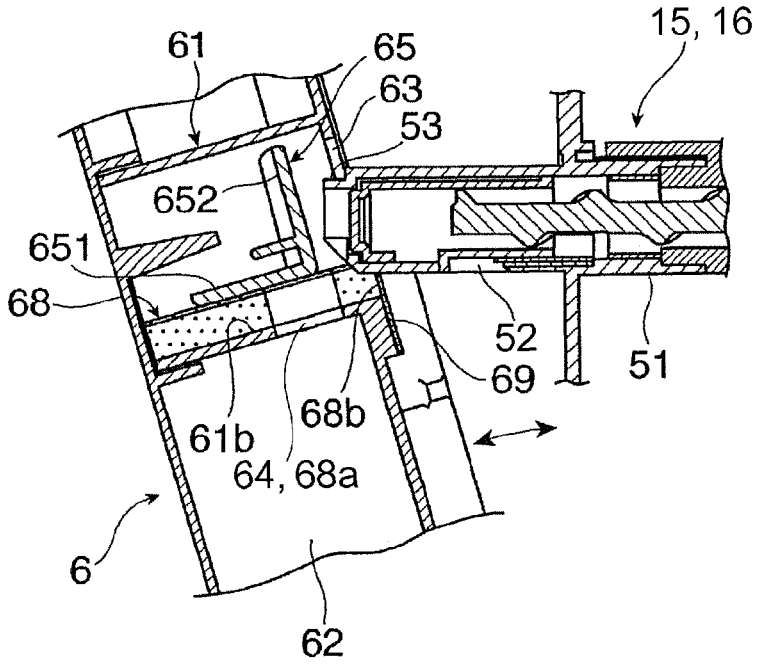
FIG. 18B is a sectional view illustrating a state of the connecting part and the developer discharge pipe at a point in time slightly advanced from that illustrated in FIG. 18A.

Continuing the swinging motion so as to further raise the developer collection box 6 results in the state as illustrated in FIG. 18B. That is, the distal end portion (in actuality, the small-diameter part 53) of the developer discharge pipe 15 or 16 comes into abutment against the abutment part 652 of the rotary shutter 65, causing the rotary shutter 65 to start to rotationally move, and also moves on forward while in contact with the sealing member 68.

At this time, as the rotary shutter 65 of the connecting part 61 is started to be pushed by the distal end portion of the developer discharge pipe 15 or 16, the rotary shutter 65 starts to rotationally move about the shaft part 653, causing the rotary shutter 65 to be displaced from a position that closes the receiving opening 64 toward a position that opens the receiving opening 64.

Further, the sealing member 68 of the connecting part 61 comes into contact with and is pushed by the small-diameter part 53 of the developer discharge pipe 15 or 16.

Furthermore, at this time, the sealing member 68 of the connecting part 61 comes into contact with and is pushed by the small-diameter part 53 of the developer discharge pipe 15 or 16.

Lastly, by further continuing the swinging operation mentioned above, the protrusion 60*a* located in the upper end portion of the developer collection box 6 is supported and locked onto the upper support part 13 of the installation part 10*f*. The developer collection box 6 is thus installed in the installation part 10*f* (see FIG. 1). Once installation of the developer collection box 6 is complete, the exterior cover (not illustrated) that covers up the installation part 10*f* (including the developer collection box 6) is closed.

As illustrated in FIGS. 11, 14, and the like, once installation of the developer collection box 6 is complete as described above, closing of the receiving opening 64 of the connecting part 61 (in actuality, the through-hole 68*a* of the sealing member 68) by the covering part 651 of the rotary shutter 65 is released so that the receiving opening 64 becomes open. That is, owing to the swinging motion of the developer collection box 6 during its installation, the rotary shutter 65 of the connecting part 61 is pushed toward the interior of the containment space (S) by the small-diameter part 53 of the developer discharge pipe 15 or 16, causing the rotary shutter 65 to rotationally move. Consequently, the covering part 651 of the rotary shutter 65 is displaced to a position that opens the receiving opening 64.

In the meantime, once installation of the developer collection box 6 is complete as described above, as illustrated in FIGS. 14, 15, and the like, in the developer discharge pipe 15 or 16, closing of the discharge opening 52 of the pipe body 51 by the slide shutter 54 is released so that the discharge opening 52 becomes open. That is, in the course of swinging the developer collection box 6 during its installation, the slide shutter 54 is abutted against and pushed by the protrusion 67 within the containment space (S) of the connecting part 61. Consequently, the slide shutter 54 moves toward the back side of the pipe body 51, causing the opening 54*a* of the slide shutter 54 to be displaced to a position opposed to the discharge opening 52 to open the discharge opening 52.

At this time, the developer collection box 6 becomes connected with the developer discharge pipe 15 or 16 as the developer discharge pipe 15 or 16 is inserted into the containment space (S) of the connecting part 61. At this time, the lower surface (contact surface) 56*c* located around the discharge opening 52 of the developer discharge pipe 15 or 16 comes into contact with the body (the portion excluding the through-hole 68*a*) of the sealing member 68. At this time, the gap between the surrounding of the receiving opening 64 in the bottom portion 61*b* of the connecting part 61 and the sliding frame 56 located around the discharge opening 52 of the developer discharge pipe 15 or 16 remains sealed by the body of the sealing member 68 (see FIG. 15 and the like).

Then, when an image forming operation or the like by the image forming apparatus 1 is performed, the developer collection box 6 installed on the image forming apparatus 1 collects developer as follows.

That is, when an image forming operation or the like is executed in the image forming apparatus 1, developer scrapped off by the drum cleaner 26 of the image forming device 20 and developer scrapped off by the belt cleaner 36 of the intermediate transfer device 30 are transported by the rotary transport members 26*b* and 36*b* through the developer discharge pipes 15 and 16, respectively. Thereafter, each of the developers is finally discharged from the discharge opening 52.

The developer discharged from the discharge opening 52 of the developer discharge pipe 15 or 16 drops through the receiving opening 64 (including the through-hole 68*a* of the sealing member 68) of the connecting part 61 of the developer collection box 6 connected with the developer discharge pipe 15 or 16, and stored into the storage space inside the storage part 62 of the developer collection box 6 so as to deposit in the storage space.

At this time, the gap between the surrounding part of the receiving opening 64 in the bottom portion 61*b* of the connecting part 61 of the developer collection box 6, and the surrounding part (the sliding frame 56) of the discharge opening 52 in the developer discharge pipe 15 or 16 is sealed by (the body of) the sealing member 68 interposed between these areas.

When the detector (not illustrated) detects that the amount of developer collected in the storage part 62 has reached an amount set as a guide for the timing to replace the developer collection box 6, the developer collection box 6 is removed from the installation part 10*f* to replace the developer collection box 6 with a new one.

To remove the developer collection box 6 from the installation part 10*f*, as described above, first, the locking of the protrusion 60*a*, which is located in the upper end portion of the developer collection box 6, on the upper support part 13 of the installation part 10*f* is released. Thereafter, the upper end portion of the developer collection box 6 is pulled forward to swing the developer collection box 6 so that the developer collection box 6 as a whole is tilted down into an oblique position (see FIGS. 3, 17, and the like).

At this time, as illustrated in FIGS. 6, 17, and the like, in each of the developer discharge pipes 15 and 16, the discharge opening 52 of the pipe body 51 becomes closed by the slide shutter 54. That is, as the developer collection box 6 swings away from the installation part 10*f* during its removal, the protrusion 67 inside the containment space (S) of the connecting part 61 moves away from the developer discharge pipe 15 or 16. Consequently, the slide shutter 54 inside the pipe body 51 moves toward the small-diameter part 53 located at the front side of the pipe body 51, causing the barrel part of the slide shutter 54 to be displaced to a position opposed to the discharge opening 52 to close the discharge opening 52.

At the same time, as illustrated in FIGS. 11, 12, 17, and the like, in the developer collection box 6, the receiving opening 64 (in actuality, the through-hole 68*a* of the sealing member 68) of the connecting part 61 becomes closed by the covering part 651 of the rotary shutter 65. That is, as the developer collection box 6 swings away from the installation part 10*f* during its removal, the developer discharge pipe 15 or 16 moves out of the containment space (S) of the connecting part 61. This releases pushing of the rotary shutter 65 by the developer discharge pipe 15 or 16, thus causing the rotary shutter 65 to rotationally move about the shaft part 653 by the spring force of the torsion spring 66. Consequently, the covering part 651 of the rotary shutter 65 is displaced so as to recover to a position that closes the receiving opening 64.

Subsequently, the developer collection box 6 as a whole is lifted obliquely forward to pull the lower mounting part 60*b* out of the lower support part 14 of the installation part 10*f*. The developer collection box 6 is thus removed from the installation part 10*f* (see FIG. 4).

During this removal of the developer collection box 6, in the developer discharge pipe 15 or 16 pulled out from the containment space (S) of the connecting part 61, the discharge opening 52 and the barrel part located in the lower surface portion of the developer discharge pipe 15 or 16 move while in contact with the sealing member 68. Therefore, developer adhering on the barrel part in an area of the lower surface portion around the discharge opening 52 of the developer discharge pipe 15 or 16 is removed through of sliding friction with the sealing member 68.

Further, in the developer collection box 6 and the image forming apparatus 1, as described above, the gap between the covering part 651 of the rotary shutter 65 of the connecting part 61 and the bottom portion 61*b* of the connecting part 61 has the same dimension (h) as that of the gap between the sliding frame 56 located around the discharge opening 52 of the developer discharge pipe 15 or 16 and the bottom portion 61*b* of the connecting part 61 (FIGS. 16A and 16B). Therefore, (the lower surface (contact surface) 651*a* of) the covering part 651 of the rotary shutter 65 and (the lower surface 56*c* of) the sliding frame 56 located around the discharge opening 52 of the developer discharge pipe 15 or 16 come into contact with the upper surface of the sealing member 68 at the same height (these contact positions (sealing surfaces) are located at the same height).

If the gaps mentioned above are set to different values, however, when the part that comes into contact with the upper surface of the sealing member 68 changes as the developer collection box 6 is installed or removed, the height of the contact position with the upper surface of the sealing member 68 tends to change. For example, the height of the upper surface of the sealing member 68 becomes low after prolonged contact with a part whose height position is relatively low. This results in loss of tight contact with the upper surface of the sealing member 68 when the part that comes into contact with the upper surface of the sealing member 68 changes. As a result, it is difficult to maintain the sealing performance of the sealing member 68 over an extended period of time. In the case of the above-mentioned configuration, from the viewpoint of reducing variation of the height of the contact position, as the sealing member 68, it is desirable to use, for example, a sealing member that has such a physical property that allows the sealing member to return to its original form even after being elastically deformed.

Other Exemplary Embodiments

In Exemplary Embodiment 1 described above, the developer collection box 6 is provided with multiple connecting parts 61. However, the number of the connecting parts 61 is set in accordance with the number of developer discharge pipes that discharge developer. In Exemplary Embodiment 1 described above, the connecting part 61 of the developer collection box 6 is provided with the protective member 69. However, the protective member 69 may be omitted.

Further, in Exemplary Embodiment 1 described above, the developer collection box 6 is of a type which is caused to swing so as to move along an arcuate trajectory relative to the installation part 10*f* of the image forming apparatus 1 for installation into or removal from the installation part 10*f*. However, the developer collection box 6 may be of a type which is moved substantially linearly relative to the installation part 10*f* of the image forming apparatus 1 for installation into or removal from the installation part 10*f*.

Furthermore, if the image forming apparatus according to the exemplary embodiment of the invention is an image forming apparatus capable of forming a color image, the image forming apparatus may be of a type which does not use an intermediate transfer device (a so-called direct transfer type with which the recording paper 9 is transported so as to pass through the first transfer position of each image forming unit so that a toner image is directly transferred to the recording paper 9). Further, the image forming apparatus according to the exemplary embodiment of the invention may be an image forming apparatus that forms a single-color image such as a monochrome image.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developer collection container comprising:

a connecting part that is removably connected to a discharge structure by moving relative to the discharge structure, the discharge structure having a discharge opening through which a developer to be collected is discharged, the connecting part having a receiving opening that comes to face the discharge opening of the discharge structure to receive the developer discharged and dropped from the discharge opening;

a storage part that is provided below the connecting part in a direction of gravity to store the developer received from the receiving opening;

an opening and closing member that is provided in a receiving area of the connecting part where the receiving opening is provided, the opening and closing member being displaced between a closed position and an open position by moving substantially in parallel to the receiving area in conjunction with relative movement of the connecting part with respect to the discharge structure, the open position being a position in which the receiving opening is open, the closed position being a position in which the receiving opening is closed, the opening and closing member having a covering part that covers the receiving opening when the opening and closing member is in the closed position;

a sealing member that is provided around the receiving opening in the receiving area, the sealing member sealing a first gap between the covering part and the receiving area when the opening and closing member is in the closed position, the sealing member sealing at least a second gap between a surrounding part of the discharge opening of the discharge structure and the receiving area when the discharge structure is connected with the connecting part; and a protective member that is provided in an end portion of the connecting part through which the discharge structure passes when the connecting part moves relative to the discharge structure, the protective member covering up and protecting an exposed area of the sealing member which is exposed at a position of the end portion.

2. The developer collection container according to claim 1, wherein the sealing member comprises a member that is elastically deformed into contact with the surrounding part of the discharge opening of the discharge structure and the covering part of the opening and closing member.

3. The developer collection container according to claim 1, wherein the first gap has a dimension equal to a dimension of the second gap.

4. The developer collection container according to claim 2, wherein the first gap has a dimension equal to a dimension of the second gap.

5. An image forming apparatus comprising:

the developer collection container according to claim 1 that is removably installed onto the image forming apparatus to store the developer discharged from the discharge opening of the discharge structure; and the discharge structure that has the discharge opening through which the developer to be collected is discharged.

6. The image forming apparatus according to claim 5, wherein:

the discharge structure has a corner portion that first comes into contact with the sealing member of the connecting part of the developer collection container during installation of the developer collection container; and the corner portion is beveled.

7. The image forming apparatus according to claim 5, wherein a contacting area in the surrounding part of the discharge opening of the discharge structure which comes into contact with the sealing member of the developer collection container is formed as a substantially smooth surface.

8. The image forming apparatus according to claim 6, wherein a contacting area in the surrounding part of the discharge opening of the discharge structure which comes into contact with the sealing member of the developer collection container is formed as a substantially smooth surface.

9. A developer collection container comprising:

a connecting part that is removably connected to a discharge structure by moving relative to the discharge structure, the discharge structure having a discharge opening through which a developer to be collected is discharged, the connecting part having a receiving opening that comes to face the discharge opening of the discharge structure to receive the developer discharged and dropped from the discharge opening;

a storage part that is provided below the connecting part in a direction of gravity to store the developer received from the receiving opening;

an opening, and closing member that is provided on the developer collection container and in a receiving area of the connecting part where the receiving opening is provided, the opening and closing member being displaced between a closed position and an open position by rotationally moving substantially in parallel to the receiving area in conjunction with relative movement of the connecting part with respect to the discharge structure, the open position being a position in which the receiving opening is open, the closed position being a position in which the receiving opening is closed, the opening and closing member having a covering part that covers the receiving opening when the opening and closing member is in the closed position, and the opening and closing member being configured so as to be in the closed position with the covering part covering the receiving opening when the developer collection container is detached from the discharge structure; and a sealing member that is provided around the receiving opening in the receiving area, the sealing member sealing a first gap between the covering part and the receiving area when the opening and closing member is in the closed position, the sealing member sealing at least a second gap between a surrounding part of the discharge opening of the discharge structure and the receiving area when the discharge structure is connected with the connecting part.

10. A developer collection container comprising:

a connecting part that is removably connected to a discharge structure by moving relative to the discharge structure, the discharge structure having a discharge opening through which a developer to be collected is discharged, the connecting part having a receiving opening that comes to face the discharge opening of the discharge structure to receive the developer discharged and dropped from the discharge opening;

a storage part that is provided below the connecting part in a direction of gravity to store the developer received from the receiving opening;

an opening and closing member that is (i) provided on the developer collection container and in a receiving area of the connecting part where the receiving opening is provided, and (ii) displaced between a closed position and an open position by moving substantially in parallel to the receiving area in conjunction with relative movement of the connecting part with respect to the discharge structure, the opening and closing member comprising:

a covering part;

a rotary shutter having an abutment part; and a shaft that rotatably supports the abutment part and the covering part, abutment of the discharge structure with the abutment part causing the rotary shutter to rotationally move and displace the rotary shutter from the closed position to the open position, the open position being a position in which the receiving opening is open, the closed position being a position in which the receiving opening is closed, the covering part covering the receiving opening when the opening and closing member is in the closed position, and the opening and closing member being configured so as to be in the closed position with the covering part covering the receiving opening when the developer collection container is detached from the discharge structure; and a sealing member that is provided around the receiving opening in the receiving area, the sealing member sealing a first gap between the covering part and the receiving area when the opening and closing member is in the closed position, the sealing member sealing at least a second gap between a surrounding part of the discharge opening of the discharge structure and the receiving area when the discharge structure is connected with the connecting part.

11. The developer collection container according to claim 9, wherein the sealing member comprises a member that is elastically deformed into contact with the surrounding part of the discharge opening of the discharge structure and the covering part of the opening and closing member.

12. The developer collection container according to claim 9, wherein the first gap has a dimension equal to a dimension of the second gap.

13. The developer collection container according to claim 11, wherein the first gap has a dimension equal to a dimension of the second gap.

14. The developer collection container according to claim 9, wherein:

the connecting part has an end portion through which the discharge structure passes when the connecting part moves relative to the discharge structure; and the developer collection container further comprises a protective member that is provided in the end portion of the connecting part, the protective member covering up and protecting an exposed area of the sealing member which is exposed at a position of the end portion.

15. An image forming apparatus comprising:

the developer collection container according to claim 9 that is removably installed onto the image forming apparatus to store the developer discharged from the discharge opening of the discharge structure; and the discharge structure that has the discharge opening through which the developer to be collected is discharged.

16. The image forming apparatus according to claim 15, wherein:

the discharge structure has a corner portion that first comes into contact with the sealing member of the connecting part of the developer collection container during installation of the developer collection container; and the corner portion is beveled.

17. The image forming apparatus according to claim 15, wherein a contacting area in the surrounding part of the discharge opening of the discharge structure which comes into contact with the sealing member of the developer collection container is formed as a substantially smooth surface.

18. The image forming apparatus according to claim 16, wherein a contacting area in the surrounding part of the discharge opening of the discharge structure which comes into contact with the sealing member of the developer collection container is formed as a substantially smooth surface.

* * * * *